US007469669B2

(12) United States Patent
Fujita et al.

(10) Patent No.: US 7,469,669 B2
(45) Date of Patent: Dec. 30, 2008

(54) VARIABLE VALVE TRAIN MECHANISM OF INTERNAL COMBUSTION ENGINE

(75) Inventors: Hideo Fujita, Shizuoka-ken (JP); Koichi Hatamura, Hiroshima (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/224,350

(22) Filed: Sep. 12, 2005

(65) Prior Publication Data

US 2006/0075982 A1 Apr. 13, 2006

Related U.S. Application Data

(63) Continuation of application No. PCT/JP2004/003076, filed on Mar. 10, 2004.

(30) Foreign Application Priority Data

Mar. 11, 2003 (JP) ..... 2003-065400
Aug. 21, 2003 (JP) ..... 2003-208302

(51) Int. Cl.
*F01L 1/34* (2006.01)

(52) U.S. Cl. ..... 123/90.16; 123/90.15; 123/90.17; 123/90.2; 123/90.21; 123/90.44

(58) Field of Classification Search ..... 123/90.16
See application file for complete search history.

(56) References Cited

U.S. PATENT DOCUMENTS 4,572,118 A 2/1986 Baguena
4,714,057 A 12/1987 Wichart
5,018,487 A 5/1991 Shinkai
5,189,998 A 3/1993 Hara
5,373,818 A 12/1994 Unger
5,601,056 A 2/1997 Kuhn et al.
6,135,075 A * 10/2000 Boertje et al. ..... 123/90.16

(Continued)

FOREIGN PATENT DOCUMENTS

DE 19708484 9/1998

(Continued)

OTHER PUBLICATIONS

Anontaphan, Thitiphol. A Study of a Mechanical Continuous Variable Rocker Arm (VRA), SAE Technical Paper Series 2003-01-0022, 2003 SAE World Congress Detroit, Michigan, Mar. 3-6, 2003.

(Continued)

*Primary Examiner*—Thomas Denion
*Assistant Examiner*—Kyle M Riddle
(74) *Attorney, Agent, or Firm*—Knobbe, Martens, Olson & Bear, LLP

(57) ABSTRACT

A rotational cam can be disposed on a camshaft rotationally driven by a crankshaft of an internal combustion engine. A swing cam can be swingable through the rotational cam. The swing cam has a rotational cam abutment portion which contacts the rotational cam and transmits driving force from the rotational cam to the swing cam. An abutment portion displacing mechanism can be provided for displacing the rotational cam abutment portion to change a relative distance between the rotational cam abutment portion and a center axis of the swing shaft. Changing the relative distance allows changing a lift and the like of a valve.

15 Claims, 19 Drawing Sheets

U.S. PATENT DOCUMENTS

| | | | | |
|---|---|---|---|---|
| 6,386,162 | B2 | 5/2002 | Himsel | |
| 6,422,187 | B2 * | 7/2002 | Fischer et al. | 123/90.16 |
| 6,425,357 | B2 | 7/2002 | Shimizu et al. | |
| 6,481,399 | B1 | 11/2002 | Morrn | |
| 6,659,053 | B1 * | 12/2003 | Cecur | 123/90.16 |
| 6,907,852 | B2 * | 6/2005 | Schleusener et al. | 123/90.16 |
| 7,069,890 | B2 | 7/2006 | Fujita et al. | |
| 7,096,835 | B2 | 8/2006 | Fujita et al. | |
| 7,168,403 | B2 | 1/2007 | Fujita et al. | |
| 2001/0052329 | A1 | 12/2001 | Himsel | |
| 2005/0126526 | A1 | 6/2005 | Fujita et al. | |
| 2005/0229882 | A1 | 10/2005 | Fujita et al. | |
| 2006/0075982 | A1 | 4/2006 | Fujita et al. | |
| 2006/0102120 | A1 | 5/2006 | Fujita et al. | |
| 2006/0107915 | A1 | 5/2006 | Fujita et al. | |
| 2006/0207532 | A1 | 9/2006 | Fujita et al. | |
| 2006/0207533 | A1 | 9/2006 | Fujita et al. | |
| 2006/0243233 | A1 | 11/2006 | Fujita et al. | |
| 2007/0028876 | A1 | 2/2007 | Fujita et al. | |
| 2007/0204820 | A1 | 9/2007 | Fujita et al. | |

FOREIGN PATENT DOCUMENTS

| | | | |
|---|---|---|---|
| DE | 10123186 | | 11/2002 |
| JP | 99707-1986 | | 6/1986 |
| JP | 9864/1987 | | 1/1987 |
| JP | 63-179257 | | 7/1988 |
| JP | 62-255538 | | 11/1988 |
| JP | 63-309707 | | 12/1988 |
| JP | 02-241916 | | 9/1990 |
| JP | 06-017626 | | 1/1994 |
| JP | 06-093816 | | 5/1994 |
| JP | 06-272525 | | 9/1994 |
| JP | 06-307219 | | 11/1994 |
| JP | 07-063023 | | 3/1995 |
| JP | 07-133709 | | 5/1995 |
| JP | 07-293216 | | 7/1995 |
| JP | 09-268907 | | 10/1997 |
| JP | 11-036833 | | 9/1999 |
| JP | 2000-213320 | | 8/2000 |
| JP | 2001-263015 | | 9/2001 |
| JP | 2002-371816 | | 12/2002 |
| JP | 2003-106123 | | 4/2003 |
| JP | 2003-148116 | | 5/2003 |
| JP | 2003-201814 | | 7/2003 |
| JP | 2003-239713 | | 8/2003 |
| WO | WO 02092972 | A1 * | 11/2002 |
| WO | WO 03/098012 | | 11/2003 |
| WO | WO 2004/097186 | A1 | 11/2004 |
| WO | WO 2005/019607 | A1 | 3/2005 |
| WO | WO 2005/019609 | A1 | 3/2005 |

OTHER PUBLICATIONS

International Search Report for Application No. PCT/JP03/06202.
International Search Report for Application No. PCT/JP03/06236.
International Search Report for Application No. PCT/JP2004/006426.
International Search Report for Application No. PCT/JP2004/006428.
International Search Report for Application No. PCT/JP2004/012191.
International Search Report for Application No. PCT/JP2004/012192.
International Search Report for Application No. PCT/JP2004/012193.

* cited by examiner

VARIABLE VALVE TRAIN MECHANISM OF INTERNAL COMBUSTION ENGINE

RELATED APPLICATIONS

This continuation application is a national phase filing under 35 U.S.C. § 371 of PCT Application No. PCT/JP2004/003076, filed Mar. 10, 2004, which claims priority to Japanese Application Nos. 2003-065400, filed Mar. 11, 2003, and 2003-208302, filed Aug. 21, 2003, the entire contents of all of which are hereby incorporated by reference.

BACKGROUND OF THE INVENTIONS

1. Field of the Inventions

The present inventions relate to a variable valve train mechanism of an internal combustion engine capable of changing a lift and the like of an intake valve or an exhaust valve of the internal combustion engine.

2. Description of the Related Art

Variable valve train mechanisms have recently been more widely incorporated into mass produced engines. Some variable vale train mechanisms are designed to control lift, and the like, of an intake valve or an exhaust valve of an internal combustion engine according to operating conditions of the internal combustion engine. Such variable valve train mechanisms improve fuel economy and provide steady operating performance under low-load conditions, and can increase intake air charging efficiency to provide sufficient engine output under high-load conditions.

These types of variable valve train mechanisms can include an intermediate driving mechanism or intermediate phase angle changing devices. The intermediate driving mechanism is driven in connection with a rotational cam on a camshaft rotationally driven by a crankshaft of the internal combustion engine, and causes an output portion to drive a valve as an input portion is driven by the rotation cam. The intermediate phase angle changing device changes a relative phase angle between the input portion and the output portion of the intermediate driving mechanism.

The intermediate phase angle changing device can be a helical spline mechanism having a sliding gear with two types of helical splines of different angles and being displaceable in the axial direction of the intermediate driving mechanism, and displacement controller for controlling axial displacement of the sliding gear. The input portion is engaged with one of the two types of helical splines of the sliding gear, and the output portion is engaged with the other.

As the input portion and the output portion are swung relative to the sliding gear according to an axial displacement of the sliding gear through the displacement controller, the input portion and the output portion in engagement with the respective helical splines of different angles of the sliding gear are also swung relative to each other. A relative angle between the input portion and the output portion is thereby changed.

The variable valve train mechanism having an intermediate driving mechanism and the intermediate phase angle changing device allows driving the valve without a long and complex link mechanism between the rotational cam and the intermediate driving mechanism. Further, changing the relative phase angle between the input portion and the output portion can advance and retard the timing of valve opening according to the driving state of the rotational cam. Thus, it is possible to control a lift and the like associated with the drive of the rotational cam (see Japanese Patent Document JP-A-2001-263015, FIGS. 21 and 24 for example.

Other types of variable valve control mechanisms include a rocker arm which abuts and is depressed by a camshaft that rotates in one direction, and an output cam which depresses a solid lifter, connected through a control cam and a control shaft. For example, such a mechanism is described in "A Study of a Mechanical Continuous Variable Rocker Arm (VRA)," by Thitiphol Anontaphan, SAE TECHNICAL PAPER SERIES No. 2003-01-0022; SAE International, USA; Mar. 3, 2003.

In this type of system, a roller is provided at one end of the rocker arm. The roller receives a load from the camshaft, which is then transmitted to an arm of the rocker arm, transmitted to a nose on the opposite side with respect to the control cam, and then transmitted from the nose to the solid lifter via the output cam, so that the lifter is moved upwardly and downwardly.

As the control cam is rotated through the control shaft, a relative angle between the rocker arm and the output cam is changed. Changing the relative angle in such manner allows adjustment of the lift of the solid lifter.

In the type of variable valve train mechanism in which a relative phase angle between the input portion and the output portion of the intermediate driving mechanism is changed by means of the helical spline mechanism as intermediate phase angle changing means so that a lift and the like of the valve is controlled, the helical spline mechanism can swing the input portion and the output portion relative to each other, but has difficulty in controlling a relative phase angle between the input portion and the output portion to a specified angle. Therefore, in some cases, precise control of a valve lift and the opening and closing timing of the valve is difficult to achieve, which results in a problem of difficulty in increasing reliability of operation of the variable valve train mechanism. Further, manufacturing the helical spline mechanism is difficult, resulting in elevated manufacturing time and cost.

Further, since adjusting valve lift is accomplished by controlling a relative phase angle between the input portion and the output portion, the timing of a maximum lift cannot be changed in some devices.

In the mechanisms which apply a load to one end of the rocker arm (roller) from the camshaft, and then transmit the load to the solid lifter via the output cam from the other end of the rocker arm, since large bending moment acts on the overall rocker arm, the rocker arm needs to have higher strength.

SUMMARY OF THE INVENTIONS

An aspect of at least one of the inventions disclosed herein includes the realization that a variable valve mechanism can be constructed by including a moveable device and a pressing member between a cam follower and a valve stem. Adjusting the moveable device changes the magnitude of the movement of the pressing device against the valve, thereby changing the maximum lift provided by the variable valve mechanism.

Thus, in accordance with an embodiment, a variable valve train mechanism of an internal combustion engine is configured to change a lift of an intake valve or an exhaust valve of the internal combustion engine. The variable valve train mechanism can comprise a camshaft rotationally driven by a crankshaft of the internal combustion engine, a rotational cam disposed on the camshaft. A swing shaft can be disposed parallel to the camshaft, and a swing cam can be supported with the swing shaft and being swingable with a movement of the rotational cam. The swing cam can have a movable rotational cam abutment portion which contacts the rotational cam and transmits driving force from the rotational cam to the swing cam. A guide portion can be configured to guide the rotational cam abutment portion in a certain direction. The swing cam can be configured to input the driving force from the rotational cam is to the guide portion via the rotational cam abutment portion so that the swing cam is swung with a movement of the rotational cam. An abutment portion displacing mechanism can be configured to displace the rotational cam abutment portion along the guide portion so as to change a relative distance between the rotational cam abutment portion and a center axis of the swing shaft. The abutment portion displacing mechanism can comprise a drive shaft having a center axis parallel to and eccentric from the center axis of the swing shaft, and an arm with one end connected to the rotational cam abutment portion and the other end connected to the drive shaft. As the swing shaft is rotated to displace the drive shaft around the center axis of the swing shaft, the rotational cam abutment portion can be displaced through the arm, so that the relative distance between the rotational cam abutment portion and the center axis of the swing shaft is changed, whereby a lift of the valve is changed.

In accordance with another embodiment, a variable valve lift mechanism can comprise a valve assembly, a cam shaft having at least one cam lobe, and a following member configured to press against the cam lobe. At least a first pressing member can be configured to be pressed by the following member so as to press the pressing member against the valve assembly. Additionally, an adjustment device can be configured to change a position of the following member relative to the pressing member.

In accordance with yet another embodiment, a variable valve lift mechanism can comprise a valve assembly, a cam shaft having at least one cam lobe, and a following member configured to press against the cam lobe. At least a first pressing member can be configured to be pressed by the following member so as to press the pressing member against the valve assembly. Additionally, the variable valve lift mechanism can include means for changing a position of the following member relative to the pressing member so as to change the maximum lift of the valve.

BRIEF DESCRIPTION OF THE DRAWINGS

These and other features, aspects and advantages of the present inventions are better understood with reference to preferred embodiments, which are illustrated in the accompanying drawings. The illustrated embodiments are merely exemplary and are not intended to define the outer limits of the scope of the present inventions. The drawings of the illustrated arrangements comprise the following figures.

DETAILED DESCRIPTION OF THE PREFERRED EMBODIMENT

Figure 1:
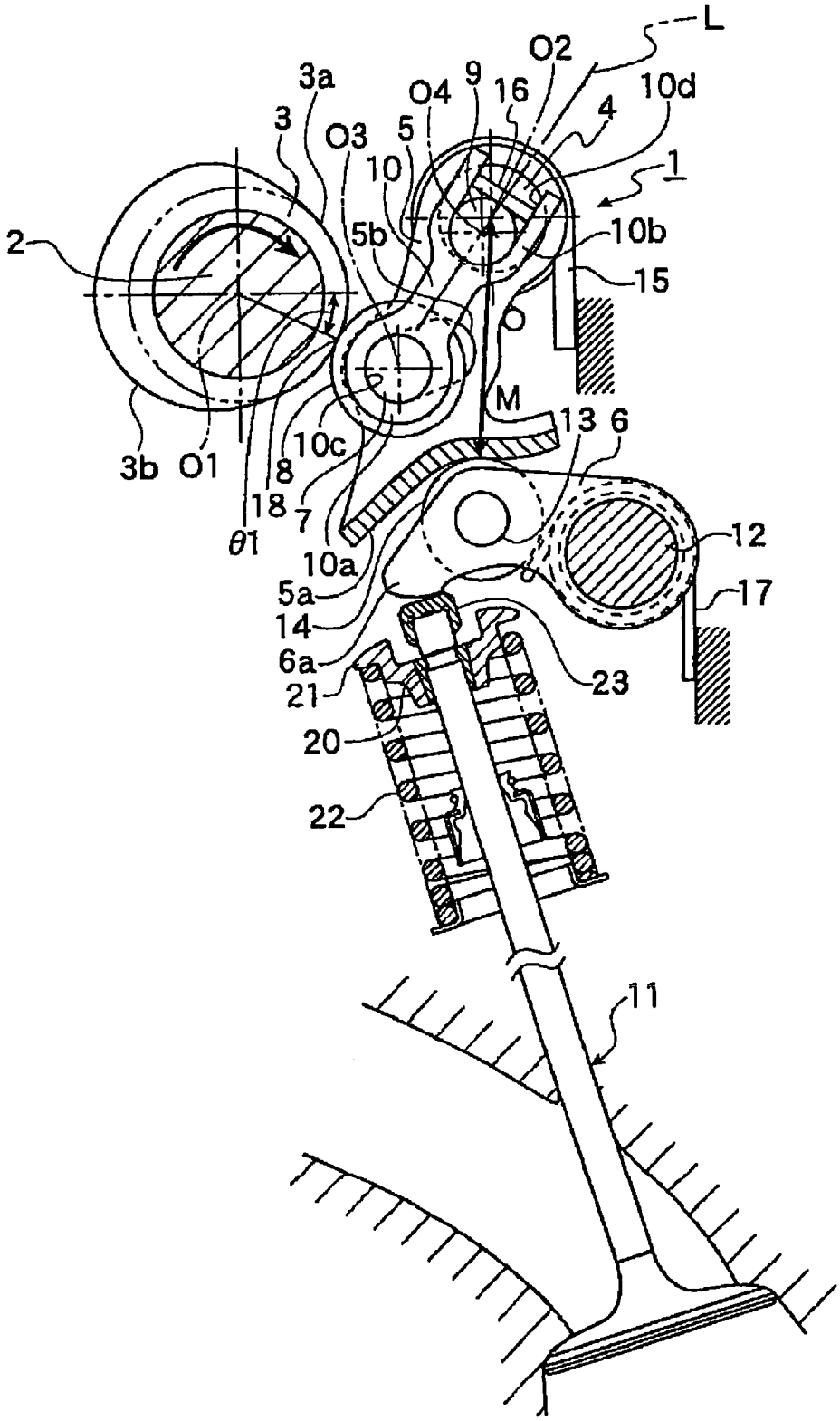
FIG. 1 is a side elevational and partial sectional view of a portion of a variable valve train mechanism of an internal combustion engine in accordance with an embodiment, the illustrated state of the mechanism corresponds to when the largest valve lift is desired, and wherein the intake valve is closed.

Reference numeral 1 in FIG. 1 denotes a variable valve train mechanism for an intake valve 11 for one of the cylinders of a multi-cylinder gasoline engine. The variable valve train mechanism is disclosed in the context of an internal combustion engine because it has particular utility in this context. Such internal combustion engines can be used in any context and be incorporated into any type of device, such as, for example, but without limitation, vehicles including at least automobiles, motorcycles, golf carts, heavy-duty transportation, boats, watercraft, outboard motors, and industrial applications including at least generators and pumps and the like. However, the variable valve train mechanism can be used in other contexts, such as, for example, but without limitation, any type of fluid control valves, for liquids, gases, or solids.

The variable valve train mechanism 1 can have a camshaft 2, a rotational cam 3, a swing shaft 4, a swing cam 5, and a rocker arm 6, although other configurations can also be used. The camshaft 2 can be rotationally driven by a crankshaft (not shown) of the internal combustion engine. The rotational cam 3 can be disposed on the camshaft 2. The swing shaft 4 can be provided generally parallel to the camshaft 2. The swing cam 5 can be supported with the swing shaft 4 and can be swingable through the rotational cam 3. The rocker arm 6 can thus swing in connection with the swing cam 5 to open and close the intake valve 11 of the internal combustion engine.

Since variable valve train mechanisms for the intake valve 11 and an exhaust valve of the gasoline engine can have the same constitution, the illustrated embodiments only show the mechanisms for intake valves. A separate description of the embodiments for exhaust valve operation is not set forth here. Rather, one of ordinary skill in the art, in light of the disclosure set forth herein, would clearly understand how to apply the illustrated embodiments and the inventions disclosed herein to exhaust valves. Further, since the other cylinders of the engine can have variable valve mechanisms that are the same or similar to the illustrated embodiments, only one cylinder is described.

As shown in FIG. 1, the camshaft 2 can be located with its length extending along the front-to-back direction of FIG. 1 (in the direction perpendicular to the illustrated view of FIG. 1), and can be rotationally driven at half the rotational speed of the crankshaft of the internal combustion engine about a center axis O1.

The rotational cam 3 can be mounted to the peripheral surface of the camshaft 2. The periphery of the rotational cam 3 can include a base face 3*a* having an arcuate shape in plan view, and a nose face 3*b* projecting from the base face 3*a*, as shown in FIG. 1.

A center axis O2 of the swing shaft 4 can be generally parallel to the center axis O1 of the camshaft 2. In some embodiments, the swing shaft 4 can be positioned separately from the camshaft 2 and parallel thereto.

Figure 5:
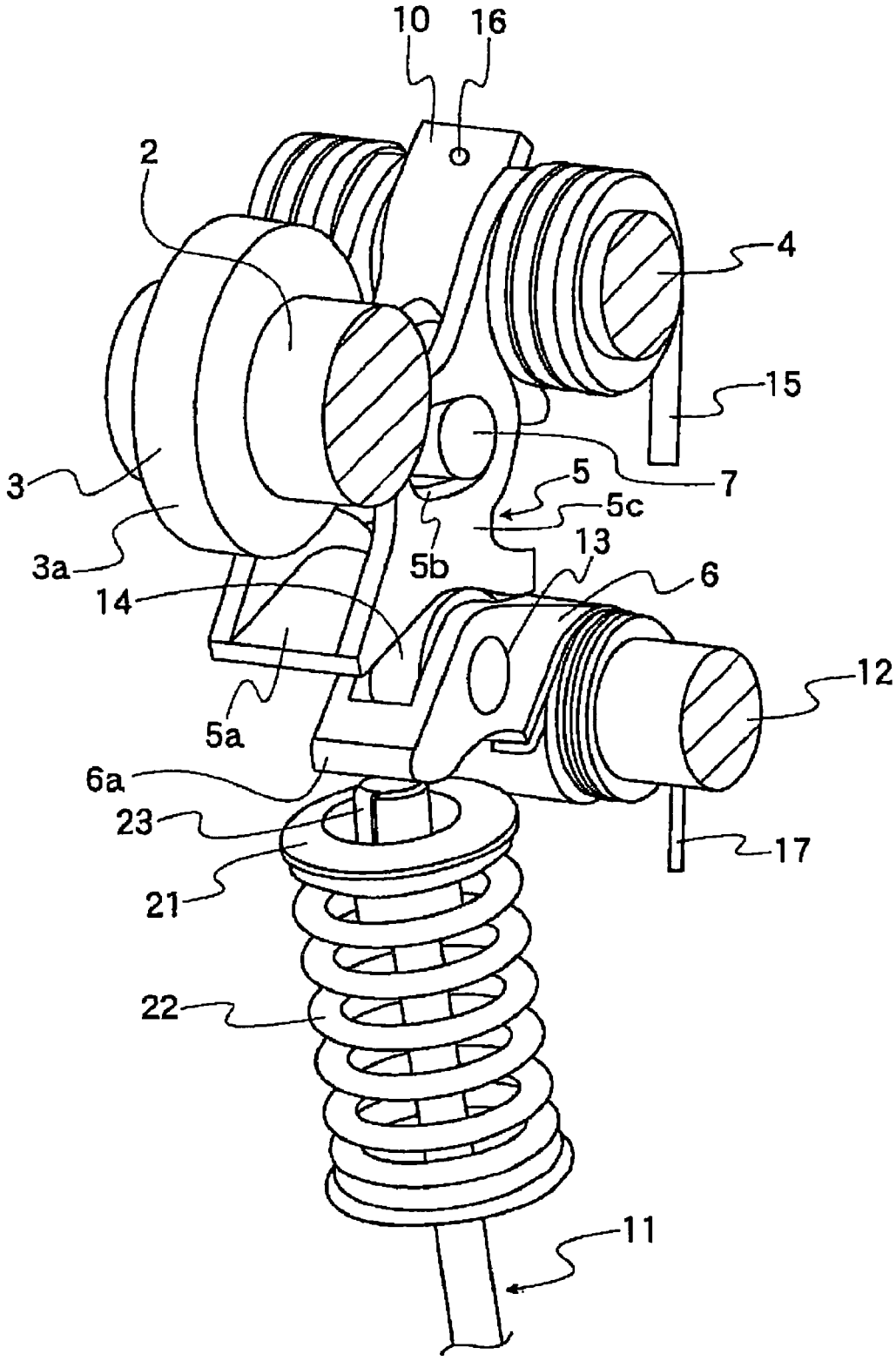
FIG. 5 is a perspective view of a portion of the variable valve train mechanism of FIG. 1.
Figure 6:
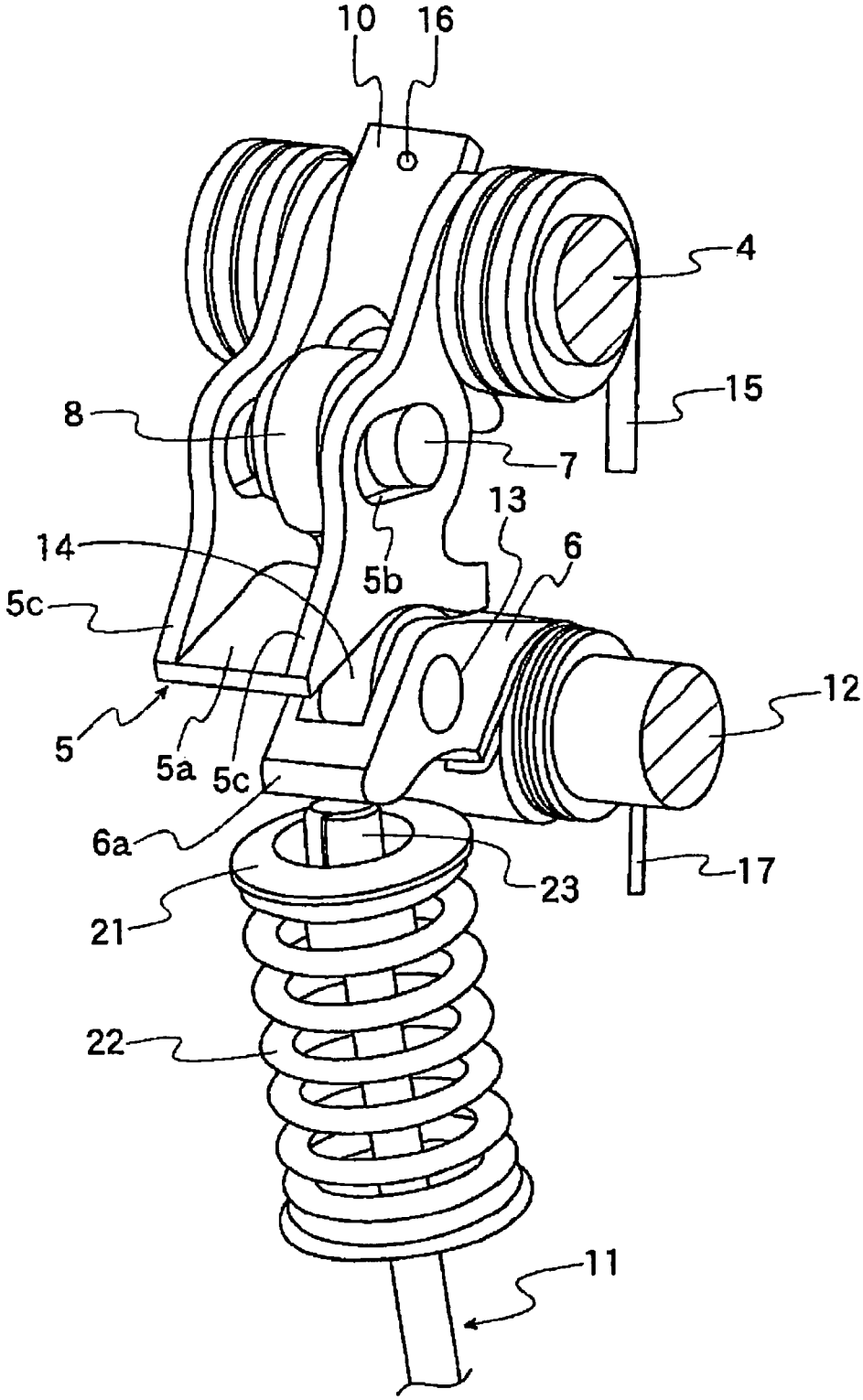
FIG. 6 is a perspective view of a portion of the variable valve train mechanism of FIG. 1, with a rotational cam and a camshaft of FIG. 5 being removed.
Figure 7:
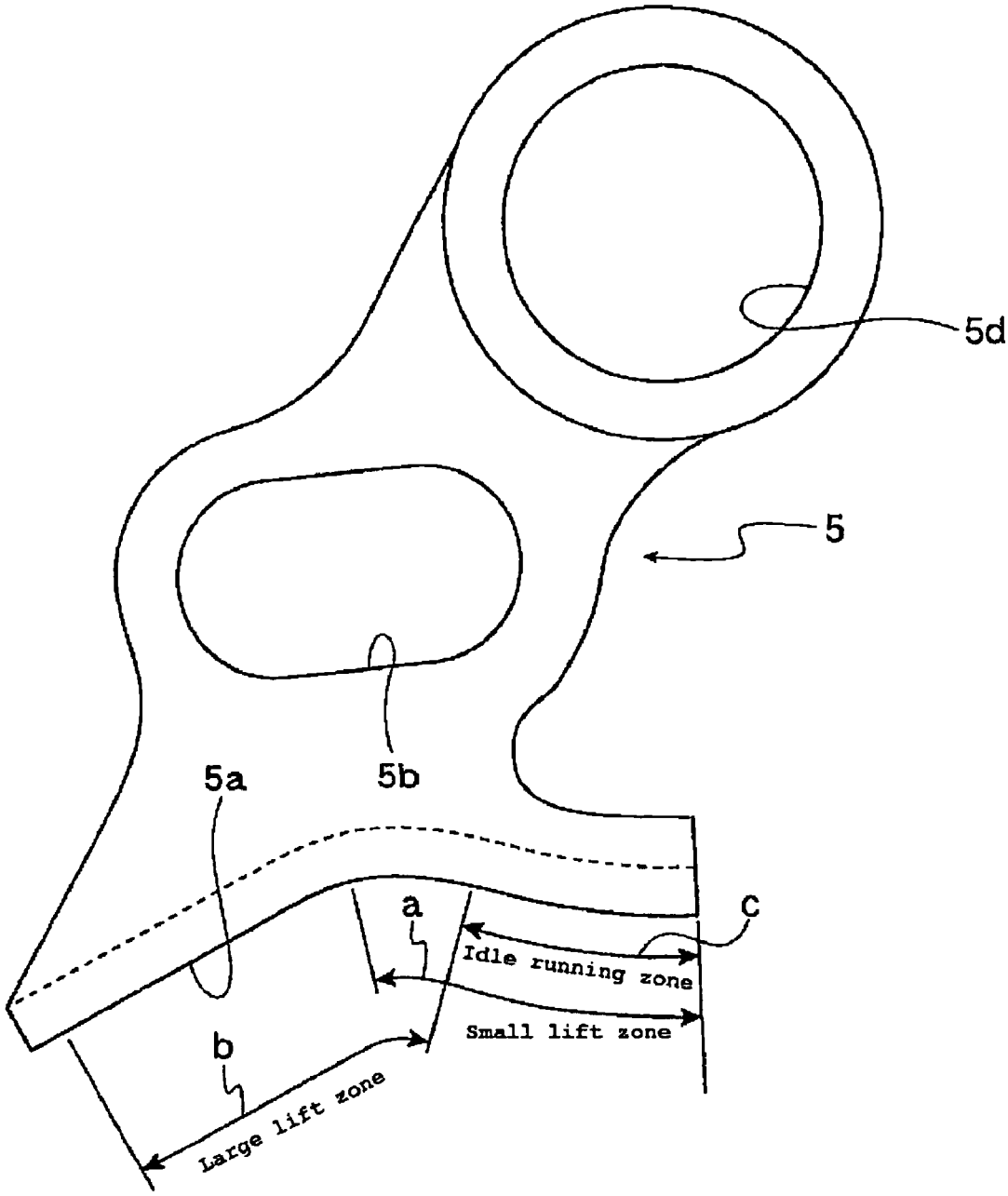
FIG. 7 is a side elevational view of a swing cam in accordance with the variable valve train mechanism of FIG. 1.

As shown in FIGS. 5 through 7 for example, the swing cam 5 can have a pair of cam plates 5*c*, and a cam face 5*a* formed between and at the bottom of the pair of cam plates 5*c*, although other configurations can also be used. The pair of cam plates 5*c* can be formed with a fitting hole 5*d* in which the swing shaft 4 can be fitted, and swingably supported about the center axis O2 of the swing shaft 4. The lower end of the swing cam 5 can have the cam face 5*a* curved toward the swing shaft 4 to form a recess, to swing the rocker arm 6.

As shown in FIG. 7, the cam face 5*a* can be made up of a small lift zone a, which can be configured to produce a smaller valve lift, and a large lift zone b, which can be configured to provide a larger valve lift. The small lift zone a can include a concentric arcuate idle running zone a centered on the center axis O2 of the swing shaft 4, although other configurations can also be used.

The pair of cam plates 5*c* of the swing cam 5 can have a slot-shaped guide portion 5*b* formed in the vertical middle portion to extend through the pair of cam plates. The guide portion 5*b* can receive a movable roller shaft 7 having a center axis O3 parallel to the center axis O2 of the swing shaft 4. The roller shaft 7 can be provided with a roller 8 which can function as a "rotational cam abutment portion," which can be configured to contact and move in connection with the base face 3*a* or nose face 3*b* of the rotational cam 3 and to transmit driving force from the rotational cam 3 to the swing cam 5.

The guide portion 5*b* can be formed in the shape of a slot to guide the roller shaft 7 longitudinally of the guide portion 5*b* for a specified distance, and the guiding direction can be inclined relative to the radial direction of the camshaft 2.

The roller 8 can be formed in a circular shape in plan view as shown in FIG. 1, and can be provided on the peripheral surface of the roller shaft 7 with its center axis being coaxial with the center axis O3 of the roller shaft 7. The roller 8 can rotate with its peripheral surface in contact with the base face 3*a* and nose face 3*b* of the rotational cam 3.

In such manner, the rotational cam abutment portion which abuts the rotational cam 3 can be formed in the shape of a roller to rotate on the rotational cam 3 face. This reduces loss of the driving force transmitted from the rotational cam 3 to the rotational cam abutment portion.

In some embodiments, the rotational cam abutment portion can be the roller 8 which rotates on the rotational cam 3 face, but is not limited to this arrangement. The rotational cam abutment portion can be the one which slides on the rotational cam 3 face in a manner that transmits the driving force from the rotational cam 3 to the swing cam 5.

The swing shaft 4 can be fitted with a spring 15 for urging the swing cam 5 toward the rotational cam 3. The swing cam 5 is thus urged toward the rotation cam 3 by the urging force of the spring 15, and the peripheral surface of the roller 8 is normally in contact with the base face 3*a* or nose face 3*b* of the rotational cam 3 during operation.

The variable valve train mechanism 1 can also be provided with an "abutment portion displacing mechanism" configured to change a relative distance between the roller 8 and the center axis O2 of the swing shaft 4.

The "abutment portion displacing mechanism" can have a drive shaft 9 fixed to the swing shaft 4, and an arm 10 with one end 10*a* connected to the roller shaft 7, and the other end 10*b* the drive shaft 9, although other configurations can also be used.

Figure 8:
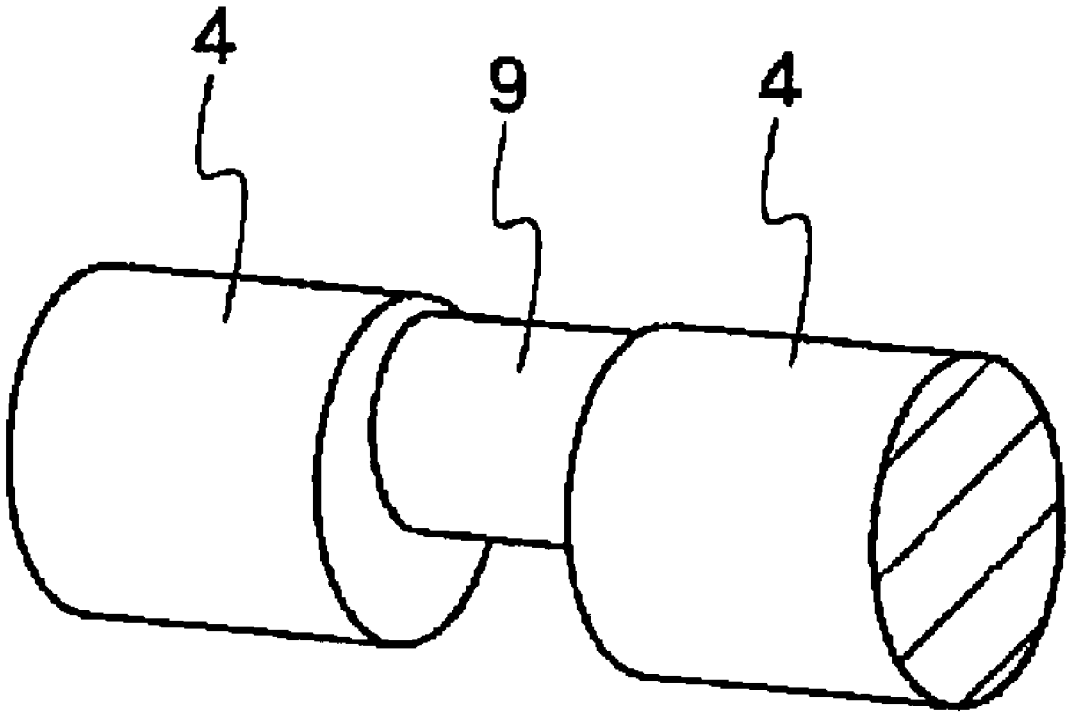
FIG. 8 is a perspective view of a swing shaft and a drive shaft in accordance with the variable valve train mechanism of FIG. 1.

As shown in FIG. 8 for example, the drive shaft 9 can be formed continuously from the swing shaft 4 in the axial direction thereof to be integral with the swing shaft 4. The drive shaft 9 has a center axis O4 parallel to and eccentric from the center axis O2 of the swing shaft 4. The drive shaft 9 can be formed in a manner such that its peripheral edge can be within the peripheral edge of the swing shaft 4, as seen in the axial direction.

An end of the swing shaft 4 can be connected to an actuator (not shown) for rotationally driving the swing shaft 4 about its center axis O2 within the range of a specified angle. The actuator can be connected to control means (not shown) for controlling an operation angle of the actuator according to operating conditions of the internal combustion engine.

As the swing shaft 4 is thereby rotated by a specified angle, the drive shaft 9 can be rotated by a specified angle about the center axis O2 of the swing shaft 4, so that the center axis O4 of the drive shaft 9 can be displaced relative to the center axis O2 of the swing shaft 4.

Figure 3:
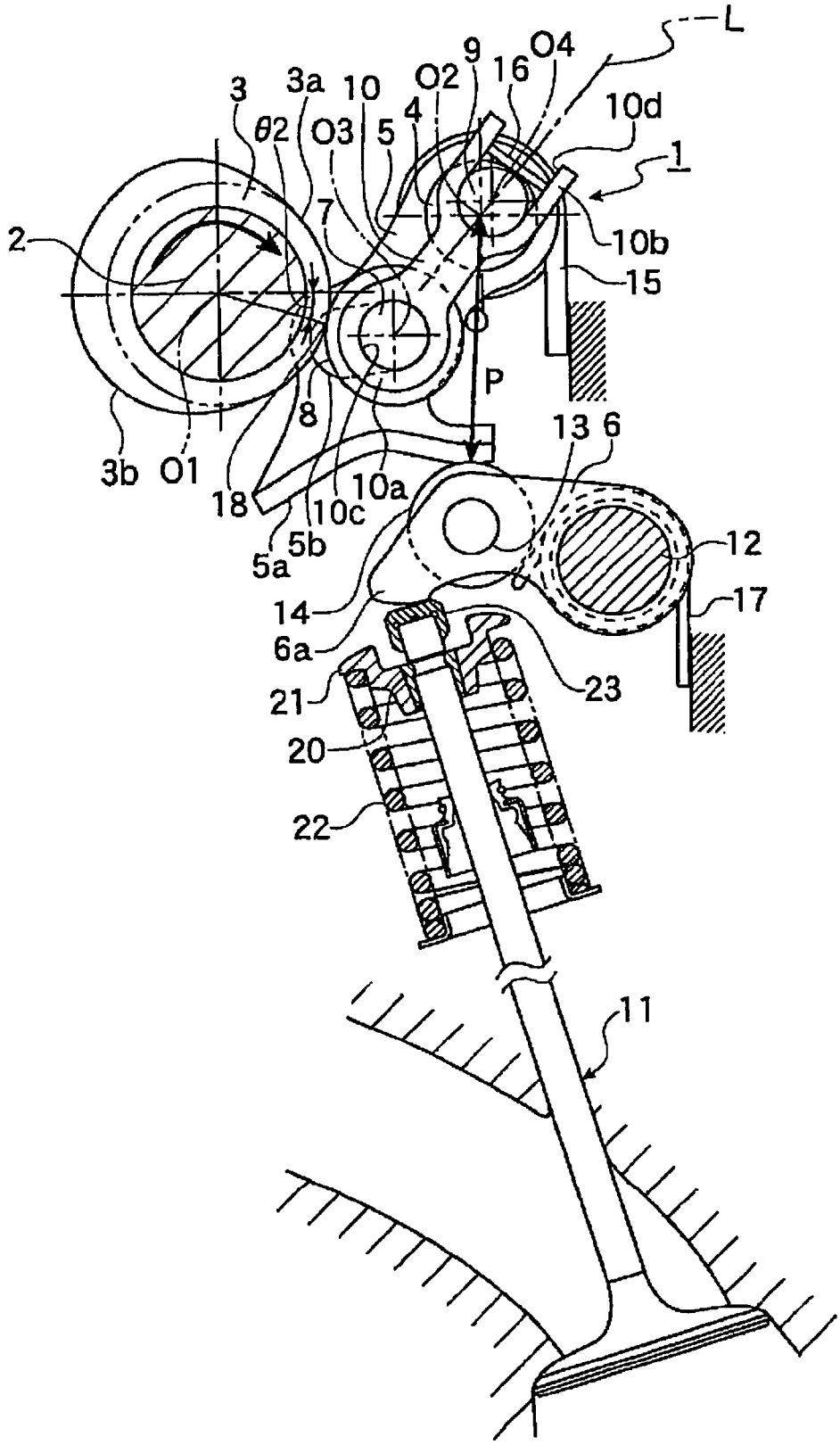
FIG. 3 is a side elevational and partial sectional view of a portion of the variable valve train mechanism of FIG. 1, the illustrated state of the mechanism corresponds to when the smallest valve lift is desired, with the intake valve being closed.

In the abutment portion displacing mechanism 1, the swing shaft 4 can be rotated about 180 degrees between a large lift setting state shown in FIG. 1 and a small lift setting state shown in FIG. 3, and in each of these setting states, the straight line L which connects the center axis O2 of the swing shaft 4 and the center axis O4 of the drive shaft 9 extends generally along the direction of extension of the arm 10. However, the swing shaft 4 can take other intermediate positions to provide intermediate valve lift settings.

As shown in FIGS. 1 and 6, the arm 10 has the shape to keep a certain distance between the center axis O3 of the roller shaft 7 and the center axis O4 of the drive shaft 9. One end 10*a* of the arm 10 can be formed with a through hole 10*c* in which the roller shaft 7 can be fitted, and the other end a semi-circular through hole 10*d* as "fitting recess" in which the drive shaft 9 can be fitted.

The roller shaft 7 can be rotatably fitted in the through hole 10*c* at the one end 10*a*, and the drive shaft 9 can be rotatably fitted in the semi-circular through hole 10*d* at the other end 10*b*. There can be provided a pin 16 as "coming-off prevention member" to prevent the drive shaft 9 from coming off the through hole 10*d*. In this mounting state, the arm 10 can be provided between the pair of cam plates 5*c* of the swing cam 5 as shown in FIG. 6.

Thus, when the swing shaft 4 is rotationally driven by a specified angle by the actuator, the drive shaft 9 which can be continuous and eccentric from the swing shaft 4 can be rotated by a specified angle about the center axis O2 of the swing shaft 4. Then, the roller shaft 7 can be rotated through the arm 10 in connection with the drive shaft 9. The roller shaft 7 can be then displaced, within the guide portion 5*b* while keeping a certain distance between the center axis O3 of the roller shaft 7 and the center axis O4 of the drive shaft 9 by means of the arm 10, so that the relative distance between the center axis O2 of the swing shaft 4 and the roller 8 can be changed. Thus, a lift and the like of the valve can be changed.

The rocker arm 6 can be swingably supported with a rocker arm shaft 12, below the swing cam 5. Although the rocker arm 6 can be swingably supported with the rocker arm shaft 12, other configurations can also be used. In some embodiments, the rocker arm 6 can be swingably supported with a spherical pivot, hydraulic lash adjuster, or the like.

An end of the rocker arm 6 can be formed with a depressing portion 6*a* for depressing the top face of a shim 23 attached on the intake valve 11, which is described below in additional detail. There can also be provided a rotatable roller shaft 13 in the middle portion of the rocker arm 6.

A roller 14 can be rotatably disposed on the roller shaft 13. The roller 14 can rotate with its peripheral surface in contact with the cam face 5*a* of the swing cam 5.

The rocker arm shaft 12 can be fitted with a spring 17 configured to urge the rocker arm 6 toward the swing cam 5. Thus, the rocker arm 6 can be urged toward the swing cam 5 by the spring 17, and the peripheral surface of the roller 14 can be normally in contact with the cam face 5*a* of the swing cam 5 during operation.

The intake valve 11, which can be depressed by the depressing portion 6*a* of the rocker arm 6, can be disposed below the depressing portion 6*a* to be vertically movable. The intake valve 11 can have a collet 20 and an upper retainer 21 at its upper portion. A valve spring 22 can be disposed below the upper retainer 21. The intake valve 11 can be urged toward the rocker arm 6 by the urging force of the valve spring 22. The top end of the intake valve 11 can be attached with the shim 23.

In such manner, the swinging motion of the swing cam 5 causes the rocker arm 6 to swing, which moves the intake valve 11 upwardly and downwardly. Thus, changing the relative distance between the center axis O2 of the swing shaft 4 and the roller 8 to control a position of the swing cam 5 at which the swing cam 5 starts swinging, allows adjustment of the timing of a maximum lift of the intake valve 11 through the rocker arm 6.

The guide portion 5*b* can be a slot inclined relative to the radial direction of the camshaft 2, but other configurations can also be used. The guide portion 5*b* can have any length configured to guide the roller 8 to a given position and allow the swing cam 5 to swing in connection with the rotational cam 3.

For example, in some embodiments, a side of the swing cam 5 on the rotational cam 3 side can be formed with an inclined surface as the guide portion 5*b* which can be inclined relative to the radial direction of the camshaft 2, so that the roller shaft 7 abuts the inclined surface and can be guided moving along it. Further, although the guiding direction of the guide portion can be inclined relative to the radial direction of the camshaft 2, other configurations can also be used. For example, changing the guiding direction to any direction can change the setting of a lift and the opening and closing timing of the valve to, for example, the one in which a lift is unchanged and the timing of a maximum lift is changed, or the one in which a lift is changed and the timing of a maximum lift is unchanged.

Figure 2:
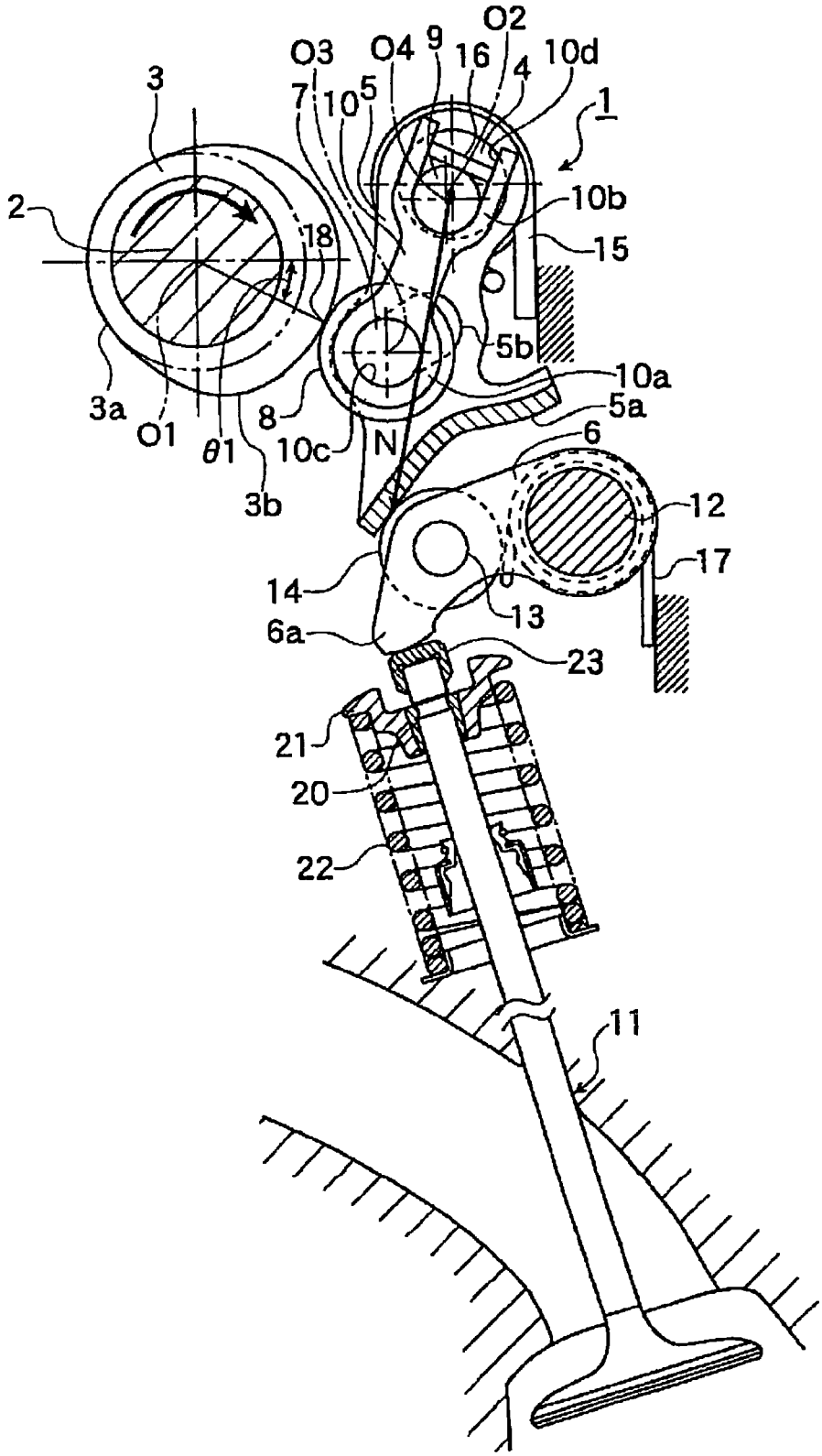
FIG. 2 is a side elevational and partial sectional view of a portion of the variable valve train mechanism of FIG. 1, the illustrated state of the mechanism corresponds to when the largest valve lift is desired, with the intake valve opened.

As noted above, FIG. 1 is a vertical sectional view of a portion of the variable valve train mechanism of an internal combustion engine in accordance with a mode of operation when the largest lift is desired, showing the state of the intake valve being closed. FIG. 2 is a vertical sectional view of a portion of the variable valve train mechanism, when the largest lift is desired, and showing the state of the intake valve being opened.

As shown in FIG. 1, the roller shaft 7 can be first displaced to the end of the guide portion 5*b* on the rotational cam 3 side, to change a relative distance between the center axis O2 of the swing shaft 4 and the roller 8. More specifically, the swing shaft 4 can be rotated by the actuator by a specified angle to displace the drive shaft 9 along the circumferential direction of the swing shaft 4. This causes the roller shaft 7 to be rotated through the arm 10 and displaced to the end of the guide portion 5*b* on the rotational cam 3 side, so that the relative distance between the center axis O2 of the swing shaft 4 and the roller 8 can be changed. Then, the cam face 5*a* of the swing cam 5 can be displaced.

As shown in FIG. 1, when the roller 8 on the swing cam 5 is in contact with the base face 3*a* of the rotational cam 3, the swing cam 5 is not swung toward the intake valve 11. Also, the rocker arm 6 can be urged toward the swing cam 5 by the urging force of the spring 17, and the intake valve 11 is urged toward a valve seat by the urging force of the valve spring 22. Thus, no lift of the intake valve 11 occurs and the intake valve 11 can be in a closed state. At this time, a small valve clearance can be present between the shim 23 of the intake valve 11 and the rocker arm 6.

Then, when the rotational cam 3 is rotationally driven through the camshaft 2 in connection with the rotation of the crankshaft of the internal combustion engine, the roller 8 can be depressed with the nose face 3*b* as shown in FIG. 2. When the roller 8 can be depressed, the swing cam 5 can be also depressed through the roller shaft 7 and swung counterclockwise in FIG. 1 against the urging force of the spring 15.

When the swing cam 5 is swung, the swing cam 5 depresses the roller 14 in contact with the central portion of the cam face 5*a* of the swing cam 5 toward the intake valve 11 using the area from the central portion to the end of the cam face 5*a* on the rotational cam 3 side (large lift zone b), and then the rocker arm 6 can be swung toward the intake valve 11 through the roller shaft 13. In such manner, the relative distance between the center axis O2 of the swing shaft 4 and the roller 14 in contact with the cam face 5*a* of the swing cam 5 can be increased from the relative distance M as shown in FIG. 1 to the relative distance N as shown in FIG. 2, and thus the rocker arm 6 can be swung toward the intake valve by a larger amount.

Figure 9:
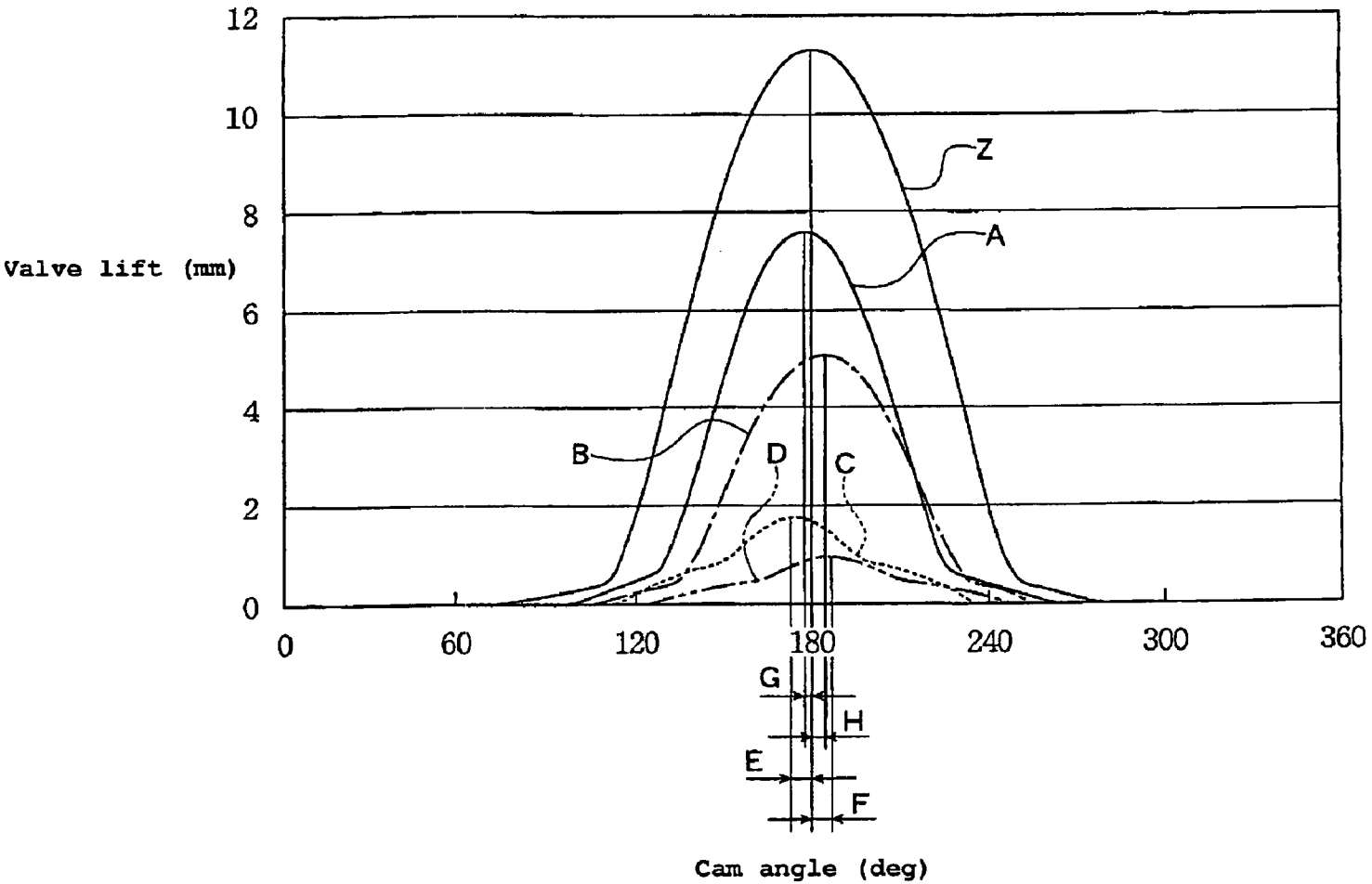
FIG. 9 is a graph showing rotational cam angles (horizontal axis) and valve lifts (vertical axis) that can describe the operation of the variable valve train mechanisms of FIGS. 1-8 and 10-13.

Then, the rocker arm 6 thus swung toward the intake valve 11 by a larger amount depresses the top face of the shim 23 with the depressing portion 6*a* formed at its end, to depress the intake valve 11 by a larger amount. As described above, when the roller shaft 7 is displaced to the end of the guide portion 5*b* on the rotational cam 3 side to change the relative distance between the center axis O2 of the swing shaft 4 and the roller 8, the relative distance from the center axis O2 of the swing shaft 4 to the roller 14 in contact with the cam face 5*a* of the swing cam 5 can be increased, so that the intake valve 11 can be depressed by a larger amount. As a result, the intake valve 11 can be opened with the largest lift, as shown in FIG. 9 by the continuous line Z.

Also, when the roller shaft 7 is displaced to the end of the guide portion 5*b* on the rotational cam 3 side so that the relative distance between the center axis O2 of the swing shaft 4 and the roller 8 can be changed, the angle 1 between the horizontal direction from the center axis O1 of the camshaft 2 and the relative direction from the center axis O1 of the camshaft 2 to a contact point 18 can be increased. The timing of a maximum lift is thus retarded.

Figure 4:
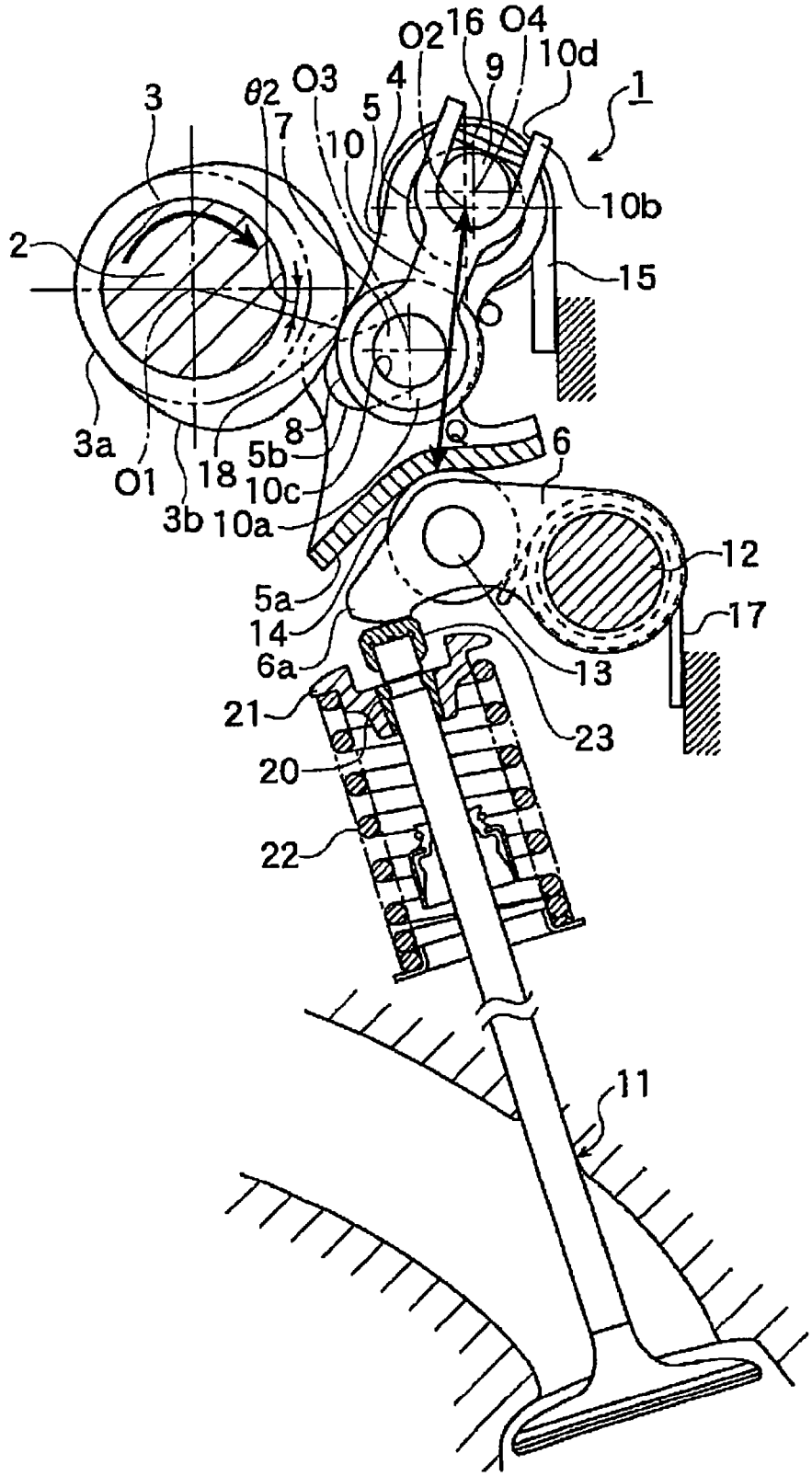
FIG. 4 is a side elevational and partial sectional view of a portion of the variable valve train mechanism of FIG. 1, the illustrated state of the mechanism corresponds to when the smallest valve lift is desired, with the intake valve being opened.

As note above, FIG. 3 is a vertical sectional view of a portion of the variable valve train mechanism of an internal combustion engine in accordance with a mode of operation for providing the smallest valve lift, and also shows the state of the intake valve being closed. FIG. 4 is a vertical sectional view of a portion of the variable valve train mechanism in the smallest valve lift mode, and shows the state of the intake valve being opened.

As shown in FIG. 3, the roller shaft 7 can be first displaced to the end of the guide portion 5*b* on the swing shaft 4 side from the end of the guide portion 5*b* on the rotational cam 3 side, at which the roller shaft 7 can be held in FIG. 1, to change the relative distance between the center axis O2 of the swing shaft 4 and the roller 8. More specifically, the swing shaft 4 can be rotated by the actuator within the range of a specified angle to displace the drive shaft 9 along the circumferential direction of the swing shaft 4. This causes the roller shaft 7 to be rotated through the arm 10 and displaced from the end of the guide portion 5*b* on the rotational cam 3 side to the end of the guide portion 5*b* on the swing shaft 4 side, so that the relative distance between the center axis O2 of the swing shaft 4 and the roller 8 can be changed. Then, the angle 1 between the horizontal direction from the center axis O1 of the camshaft 2 and the relative direction from the center axis O1 of the camshaft 2 to the contact point 18 as shown in FIGS. 1 and 2 can be reduced to the angle 2 as shown in FIGS. 3 and 4. Also, the swing cam 5 can be urged from its position shown in FIG. 1 toward the rotational cam 3 by the urging force of the spring 15, as shown in FIG. 3, and the cam face 5*a* of the swing cam 5 can be swung toward the rotational cam 3.

As shown in FIG. 3, when the roller 8 on the swing cam 5 is in contact with the base face 3*a* of the rotational cam 3 by means of the spring 15, the swing cam 5 is not swung toward the intake valve 11. Also, the rocker arm 6 can be urged toward the swing cam 5 by the urging force of the spring 17, and the intake valve 11 can be urged toward a valve seat by the urging force of the valve spring 22. Thus, no lift of the intake valve 11 occurs and the intake valve 11 is in a closed state. At this time as well, a valve clearance can be present between the shim 23 and the rocker arm 6.

Then, when the rotational cam 3 is rotationally driven through the camshaft 2 in connection with the rotation of the crankshaft of the internal combustion engine, the roller 8 can be depressed with the nose face 3*b* as shown in FIG. 4. When the roller 8 is depressed, the swing cam 5 is also depressed through the roller shaft 7 and swung counterclockwise in FIG. 3 against the urging force of the spring 15.

Additionally, as shown in FIGS. 3 and 4, the angle 2 between the horizontal direction from the center axis O1 of the camshaft 2 and the relative direction from the center axis O1 of the camshaft 2 to the contact point 18 is smaller than the angle 1, at which the largest lift is desired, as described above. Thus, the position of the swing cam 5 at which the swing cam 5 starts swinging is advanced.

When the swing cam 5 is swung, the swing cam 5 depresses the roller 14 in contact with the end of the cam face 5*a* of the swing cam 5 on the swing shaft 4 side toward the intake valve 11 using the area from the end of the cam face 5*a* on the swing shaft 4 side to the central portion of the cam face 5*a* (small lift zone a), and then the rocker arm 6 can be swung toward the intake valve 11 through the roller shaft 13. Incidentally, the rocker arm 6 is not swung while the roller 14 is moving along the idle running zone c of the small lift zone a.

In such manner, the relative distance between the center axis O2 of the swing shaft 4 and the roller 14 in contact with the cam face 5*a* of the swing cam 5 is reduced from the relative distance P as shown in FIG. 3 to the relative distance Q as shown in FIG. 4, and thus the rocker arm 6 is swung toward the intake valve by a smaller amount.

Then, the rocker arm 6 swung toward the intake valve 11 by a smaller amount depresses the top face of the shim 23 with the depressing portion 6*a* formed at its end, to depress the intake valve 11 by a smaller amount. As described above, when the roller shaft 7 is displaced to the end of the guide portion 5*b* on the swing shaft 4 side to change the relative distance between the center axis O2 of the swing shaft 4 and the roller 8, the relative distance from the center axis O2 of the swing shaft 4 to the roller 14 in contact with the cam face 5*a* of the swing cam 5 can be reduced, so that the intake valve 11 can be depressed by a smaller amount. As a result, the intake valve 11 can be opened with the smallest lift, as shown in FIG. 9 by the broken line C.

Further, with the mechanism illustrated in FIGS. 1-4, when the roller shaft 7 is displaced to the end of the guide portion 5*b* on the swing shaft 4 side to depress the intake valve 11, a valve opening becomes small. However, since the relative distance between the center axis O2 of the swing shaft 4 and the roller 8 in contact with the nose face 3*b* can be reduced, and thus a lever ratio of the swing cam 5 can be increased, a higher lift can be achieved for a small opening.

Further, when the roller shaft 7 is displaced to the end of the guide portion 5*b* on the swing shaft 4 side so that the relative distance between the center axis O2 of the swing shaft 4 and the roller 8 can be changed, the angle 2 between the horizontal direction from the center axis O1 of the camshaft 2 and the relative direction from the center axis O1 of the camshaft 2 to the contact point 18 can be reduced as shown in FIGS. 3 and 4. Thus, as shown in FIG. 9, there is caused a difference of angle E between a cam angle at the time of a maximum lift on the straight line Z, which shows the largest lift, and a cam angle at the time of a maximum lift on the broken line C, which shows the smallest lift in the Embodiment 1, and the timing of the maximum lift is advanced by such difference of angle E.

Further, when the roller shaft 7 is displaced to the central portion of the guide portion 5*b* to change the relative distance between the center axis O2 of the swing shaft 4 and the roller 8, the timing of a maximum lift and a lift as shown in FIG. 9 by the continuous line A are obtained.

More specifically, when the roller shaft 7 is displaced toward the central portion of the guide portion 5*b*, the angle between the horizontal direction from the center axis O1 of the camshaft 2 and the relative direction from the center axis O1 of the camshaft 2 to the contact point 18 becomes smaller than the angle 1, at which the lift is the largest as shown in FIGS. 1 and 2.

Thus, as shown in FIG. 9, there can be a difference of angle G between a cam angle at the time of a maximum lift on the straight line Z, which shows the largest lift, and a cam angle at the time of a maximum lift on the straight line A, and the timing of the maximum lift is advanced by such difference of angle G.

Also, since the angle between the horizontal direction from the center axis O1 of the camshaft 2 and the relative direction from the center axis O1 of the camshaft 2 to the contact point 18 can be larger than the angle 2, at which the lift is the smallest as shown in FIGS. 3 and 4, the timing of a maximum lift is later than when the lift is the smallest as shown in FIG. 9 by the broken line C. Meanwhile, the valve lift provided by the mechanism is set to intermediate lifts when operated in intermediate orientations of the shaft 4.

As seen in the foregoing, as the roller shaft 7 can be displaced to the end of the guide portion 5*b* on the swing shaft 4 side to change the relative distance between the center axis O2 of the swing shaft 4 and the roller 8, the lift can be reduced and the timing of the maximum lift can be advanced in the order of the continuous line Z, continuous line A and broken line C in FIG. 9, with reference to the timing of the maximum lift when the roller shaft 7 can be displaced to the end of the guide portion 5*b* on the rotational cam 3 side in the Embodiment 1, namely, when the largest lift can be obtained.

In the variable valve train mechanism 1 of an internal combustion engine constituted as above, the swing cam 5 can be provided with the roller 8 as the rotational cam abutment portion, which contacts the rotational cam 3 and transmits the driving force from the rotational cam to the swing cam 5. The abutment portion displacing mechanism can be configured to displace the roller 8 to change a relative distance between the roller 8 and the center axis O2 of the swing shaft 4, and changing the relative distance allows changing a lift and the like of the valve. The structure is thus simplified, thereby reducing manufacturing cost. Further, controlling the valve lift and timing of the maximum valve lift is not achieved by means of the spline mechanism as in the conventional art. The valve lift and timing of the maximum valve lift are, therefore, changed through reliable operation, and reliability is enhanced.

Further, a load from the rotational cam 3 can be input to the roller 8, and then directly transmitted to the guide portion 5*a* of the swing cam 5 from the roller shaft 7, and then from the swing cam 5, transmitted to the intake valve 11 via the rocker arm 6. Therefore, unlike the conventional art, no large bending moment acts on the arm 10 for supporting the roller 8, but only a compressive force is exerted longitudinally on the arm 10. Thus, there is no need to significantly increase the strength of the arm 10, thereby preventing an increase in weight and size of the arm 10.

On the other hand, in some of the prior art devices noted above, a load is input to the roller at one end of the rocker arm and then transmitted to the nose opposite the roller with respect to the control cam. Since large bending moment acts on the overall length of the rocker arm, the strength of the rocker arm necessarily needs to be increased.

The abutment portion displacing mechanism has the drive shaft 9 disposed to be movable so that the center axis O4 of the drive shaft 9 can be displaced relative to the center axis O2 of the swing shaft 4, and the arm 10 with one end 10*a* connected to the roller shaft 7, and the other end 10*b* the drive shaft 9. As the drive shaft 9 is displaced, the roller 8 can be displaced through the arm 10 and the roller shaft 7, so that the relative distance between the roller 8 and the center axis O2 of the swing shaft 4 can be changed. Thus, the relative distance between the roller 8 and the center axis O2 of the swing shaft 4 can be easily changed with a simple constitution, so that a combination of the valve lift and timing of the maximum valve lift can be flexibly changed.

The drive shaft 9 can be provided in the swing shaft 4, and the center axis O4 of the drive shaft 9 can be eccentric from the center axis O2 of the swing shaft 4. As the swing shaft 4 can be rotated to a specified angle, the roller shaft 7 can be displaced through the arm 10 to change the relative distance between the roller 8 and the center axis O2 of the swing shaft 4. Thus, the structure can be simplified and the variable valve train mechanism 1 can be compactly made.

The swing cam 5 has the guide portion 5*b* for guiding the roller 8 to a given position. The guiding direction of the guide portion 5*b* can be inclined relative to the radial direction of the camshaft 2. Thus, simply displacing the roller 8 along the guide portion 5*b* can easily change the relative distance between the center axis O3 of the roller shaft 7 and the center axis O2 of the swing shaft 4, so that the lift and opening and closing timing of the valve can be changed. Further, the guide portion 5*b* can be a slot. This prevents the roller shaft 7 from falling off in assembling the variable valve train mechanism 1, thereby facilitating assembly work.

Further, as noted above, the drive shaft 9 can be formed continuously with the swing shaft 4 along the axial direction thereof and having the center axis O4 parallel to and eccentric from the center axis O2 of the swing shaft 4. The arm 10 can be rotatably attached to the drive shaft 9. Therefore, even when a rotational angle of the swing shaft 4 is increased, the arm 10 can be prevented from interfering with the swing shaft 4, which allows the amount of change in the relative distance to be larger. Further, even when the distance between the center axis O2 of the swing shaft 4 and the center axis O4 of the drive shaft 9 can be shortened, such amount of change in the relative distance can be provided. Thus, twisting moment transmitted from the arm 10 via the drive shaft 9 and exerted on the swing shaft 4 can be reduced.

Further, since the rotational angle of the swing shaft 4 can be increased for the amount of change in the relative distance, fine adjustments to the relative distance are easily made, and good controllability of the swing shaft 4 for rotation can be provided.

Further, the drive shaft 9 can be formed in a manner such that its peripheral edge can be within the peripheral edge of the swing shaft 4, as seen in the axial direction. Thus, the drive shaft 9 can be easily formed, and the twisting moment exerted on the swing shaft 4 can be reduced.

Further, the arm 10 can be formed with the semi-circular through hole 10*d*, and the pin 16 can be provided, on the side of an open end of the semi-circular through hole 10*d*, for preventing the drive shaft 9 from coming off toward the open end. Thus, the arm 10 can be easily connected to the drive shaft 9. Further, while the rotational cam 3 is being driven, a compressive force acts on the arm 10, and thus no large force acts on the pin 16. Therefore, this coming-off prevention member can have less strength.

Further, since the swing cam 5 can be urged toward the rotational cam 3 by the spring 15, normally no gap is created between the rotational cam 3 and the swing cam 5 even when there is a valve clearance. The swing cam 5 moves smoothly along the rotational cam face and can be prevented from being hit with the rotational cam 3. Specifically, although the cam face 5*a* of the swing cam 5 includes the idle running zone c, and since the swing cam 5 normally moves along the rotational cam face, the swing cam 5 can be prevented from being hit with the rotational cam 3.

Further, the rocker arm 6, which can be swung by the swing cam 5, can be urged toward the swing cam 5 by the spring 17. Thus, looseness between the rocker arm 6 and the swing cam 5 can be prevented even when there is a valve clearance. Further, since the roller 14 does not rotate by itself, wear can be restricted in a sliding contact portion between the roller 14 and the swing cam 5.

Further, the actuator can be provided at one end of the swing shaft 4. Thus, driving the actuator causes the plural drive shafts 9 for the respective cylinders to be displaced.

Further, in the abutment portion displacing mechanism, the swing shaft 4 can be rotated about 180 degrees between a small lift setting state (or "small lift mode") and a large lift setting state (or "large lift mode"), and in each setting state, the straight line L which connects the center axis O2 of the swing shaft 4 and the center axis O4 of the drive shaft 9 extends generally along the direction of extension of the arm 10. Therefore, even when a force is exerted on the arm 10 by the rotational cam 3, no twisting moment acts on the swing shaft 4, which allows reducing the strength of the swing shaft 4. This can be especially advantageous in the largest lift duration, and also provides good controllability of the arm 10 in the smallest lift duration, when the motion of the arm 10 in connection with the rotation of the swing shaft 4 becomes less responsive.

Figure 10:
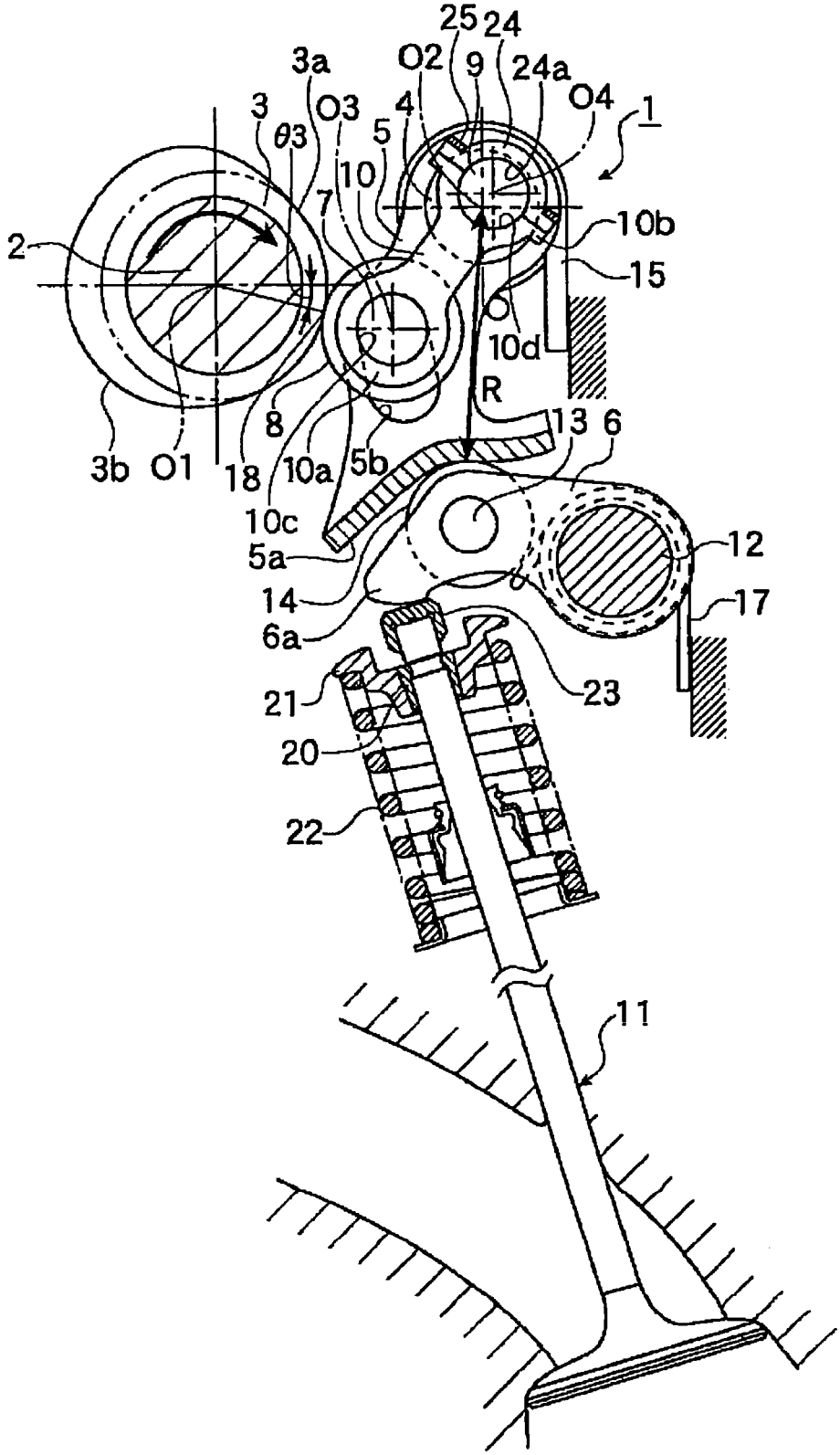
FIG. 10 is a side elevational and partial sectional view of a portion of a variable valve train mechanism of an internal combustion engine in accordance a modification o the mechanism of FIG. 1, the illustrated state of the mechanism corresponds to when the largest lift is desired, with intake valve being closed.

FIGS. 10 through 13 show a modification of the variable valve mechanism of FIGS. 1-4. In this embodiment, as shown in FIG. 10, a guide portion 5*b*, which can be a slot similar to that illustrated in FIGS. 1-4, can be inclined in a direction opposite the direction shown in FIGS. 1-4, relative to the radial direction of a camshaft 2. The guide portion 5*b* can be formed in a manner such that a roller shaft 7 can be displaced vertically of a swing cam 5.

There can be provided an arm 10 with one end 10*a* formed with a through hole 10*c* in which the roller shaft 7 can be fitted, and at the other end, a semi-circular through hole 10*d* in which a drive shaft 9 can be fitted. The roller shaft 7 can be rotatably fitted in the through hole 10*c* at the one end 10*a*, and the drive shaft 9 can be rotatably fitted in the semi-circular through hole 10*d* at the other end 10*b*.

A fixing member 24 can have a fitting portion 24*a* in which the drive shaft 9 can be fitted. The fixing member 24 can be mounted to the other end 10*b* of the arm 10 with mounting bolts 25 to prevent the arm 10 from coming off the drive shaft 9.

Figure 11:
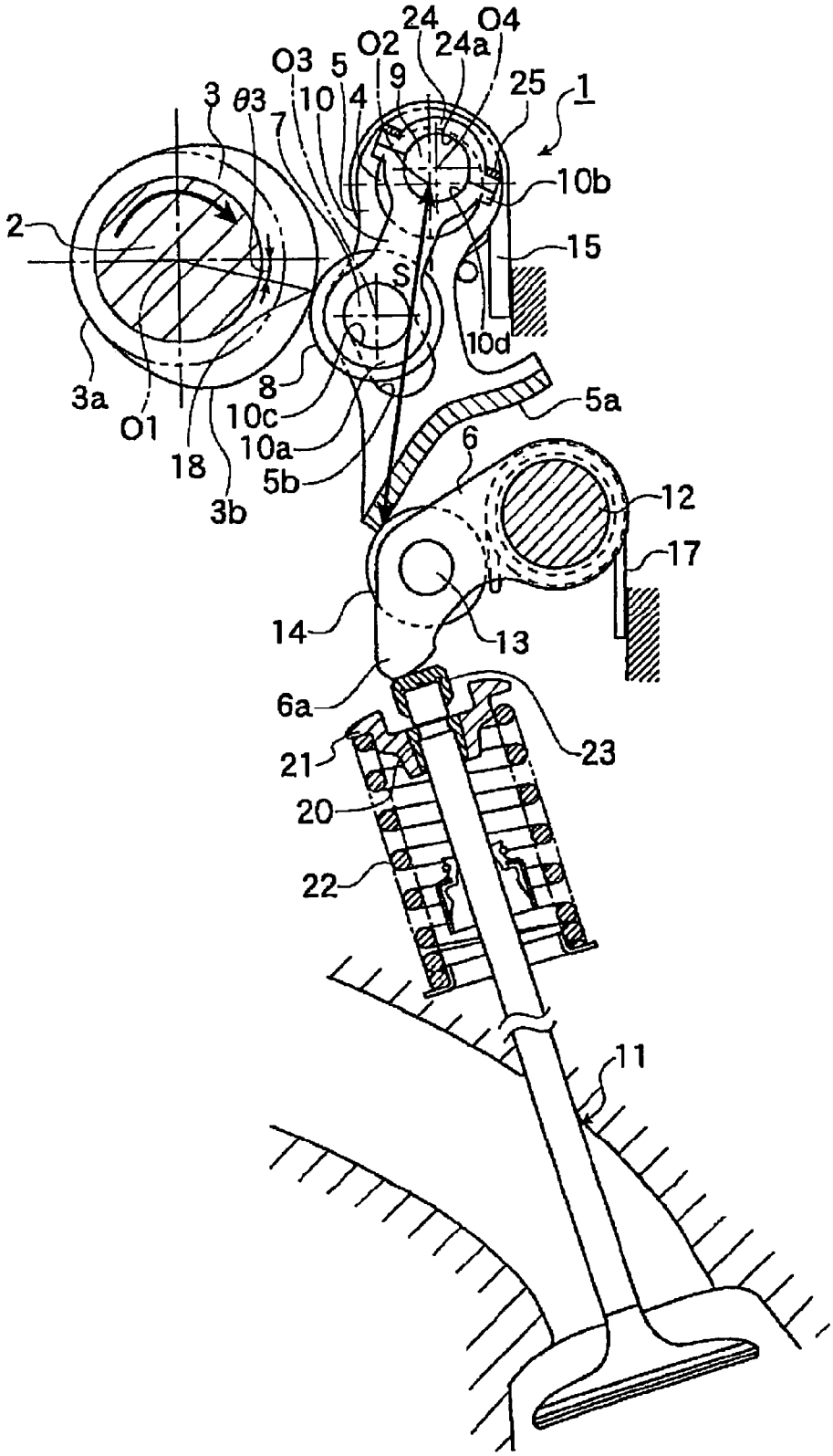
FIG. 11 is a side elevational and partial sectional view of a portion of the variable valve train mechanism of FIG. 10, the illustrated state of the mechanism corresponds to when the largest lift is desired, with the intake valve being opened.

FIG. 10 is a vertical sectional view of a portion of the variable valve train mechanism, arranged in a mode for providing the largest valve lift, and shows the state of the intake valve being closed. FIG. 11 is another vertical sectional view of the variable valve train mechanism in the largest valve lift mode and showing the intake valve being opened.

With reference to FIG. 10, during operation, the roller shaft 7 can be first displaced to the end of the guide portion 5*b* on the swing shaft 4 side, to change a relative distance between a center axis O2 of the swing shaft 4 and a roller 8. For example, the swing shaft 4 can be rotated by the actuator (not shown) by a specified angle to displace the drive shaft 9 along the circumferential direction of the swing shaft 4. This causes the roller shaft 7 to be rotated through the arm 10 and displaced to the end of the guide portion 5*b* on the rotational cam 3 side, so that the relative distance between the center axis O2 of the swing shaft 4 and the roller 8 is changed. This allows a cam face 5*a* of the swing cam 5 to be displaced.

As shown in FIG. 10, when the roller 8 on the swing cam 5 is in contact with a base face 3*a* of the rotational cam 3, the swing cam 5 is not swung toward an intake valve 11. Also, a rocker arm 6 is urged toward the swing cam 5 by the urging force of a spring 17, and the intake valve 11 can be urged toward a valve seat by the urging force of a valve spring 22. Thus, no lift of the intake valve 11 occurs and the intake valve 11 is in a closed state. At this time, a valve clearance is present between a shim 23 of the intake valve 11 and the rocker arm 6.

Then, when the rotational cam 3 is rotationally driven through the camshaft 2 in connection with the rotation of a crankshaft of the internal combustion engine, the roller 8 can be depressed with a nose face 3*b* as shown in FIG. 11. When the roller 8 is depressed, the swing cam 5 can be also depressed through the roller shaft 7 and swung counterclockwise in FIG. 10 against the urging force of a spring 15.

When the swing cam 5 is swung, the swing cam 5 depresses a roller 14 in contact with the central portion of the cam face 5*a* of the swing cam 5 toward the intake valve 11 using the area from the central portion to the end of the cam face 5*a* on the rotational cam 3 side, and then the rocker arm 6 can be swung toward the intake valve 11 through a roller shaft 13. In such manner, the relative distance between the center axis O2 of the swing shaft 4 and the roller 14 in contact with the cam face 5*a* of the swing cam 5 can be increased from the relative distance R as shown in FIG. 10 to the relative distance S as shown in FIG. 11, and thus the rocker arm 6 can be swung toward the intake valve by a larger amount.

Then, the rocker arm 6 is thus swung toward the intake valve 11 by a larger amount depresses the top face of the shim 23 with a depressing portion 6*a* formed at its end, to depress the intake valve 11 by a larger amount. As described above, when the roller shaft 7 is displaced toward the end of the guide portion 5*b* on the swing shaft 4 side to change the relative distance between the center axis O2 of the swing shaft 4 and the roller 8, the relative distance from the center axis O2 of the swing shaft 4 to the roller 14 in contact with the cam face 5*a* of the swing cam 5 can be increased, so that the intake valve 11 can be depressed by a larger amount. As a result, the intake valve 11 can be opened with the largest lift, as shown in FIG. 9 by the continuous line Z.

Also, when the roller shaft 7 is displaced to the end of the guide portion 5*b* on the swing shaft 4 side so that the relative distance between the center axis O2 of the swing shaft 4 and the roller 8 can be changed, the angle 3 between the horizontal direction from a center axis O1 of the camshaft 2 and the relative direction from the center axis O1 of the camshaft 2 to a contact point 18 can be reduced as shown in FIGS. 10 and 11. The timing of a maximum lift is thus advanced.

Figure 12:
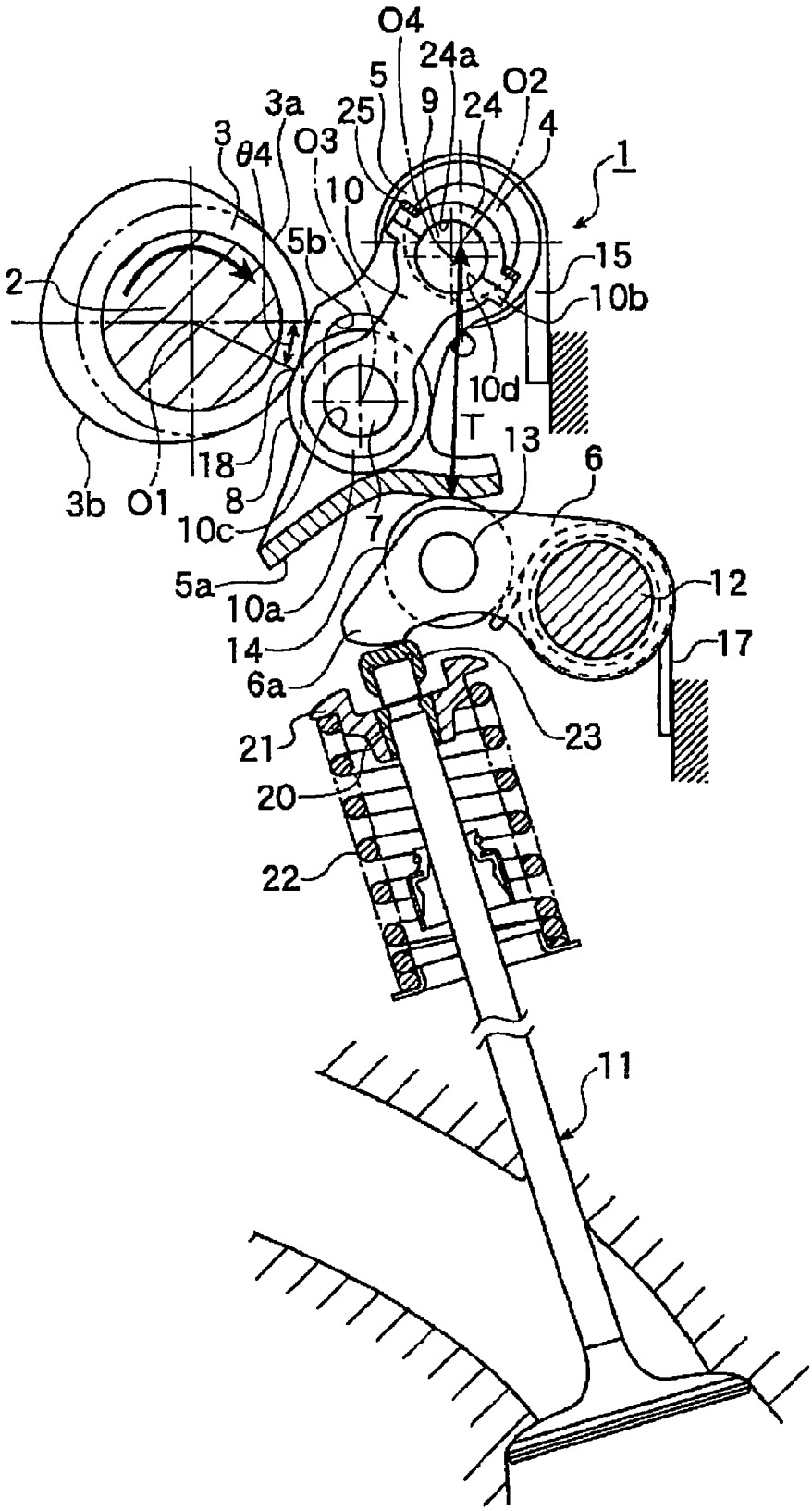
FIG. 12 is a side elevational and partial sectional view of a portion of the variable valve train mechanism of FIG. 10, the illustrated state of the mechanism corresponds to when the smallest lift is desired, when the intake valve being closed.
Figure 13:
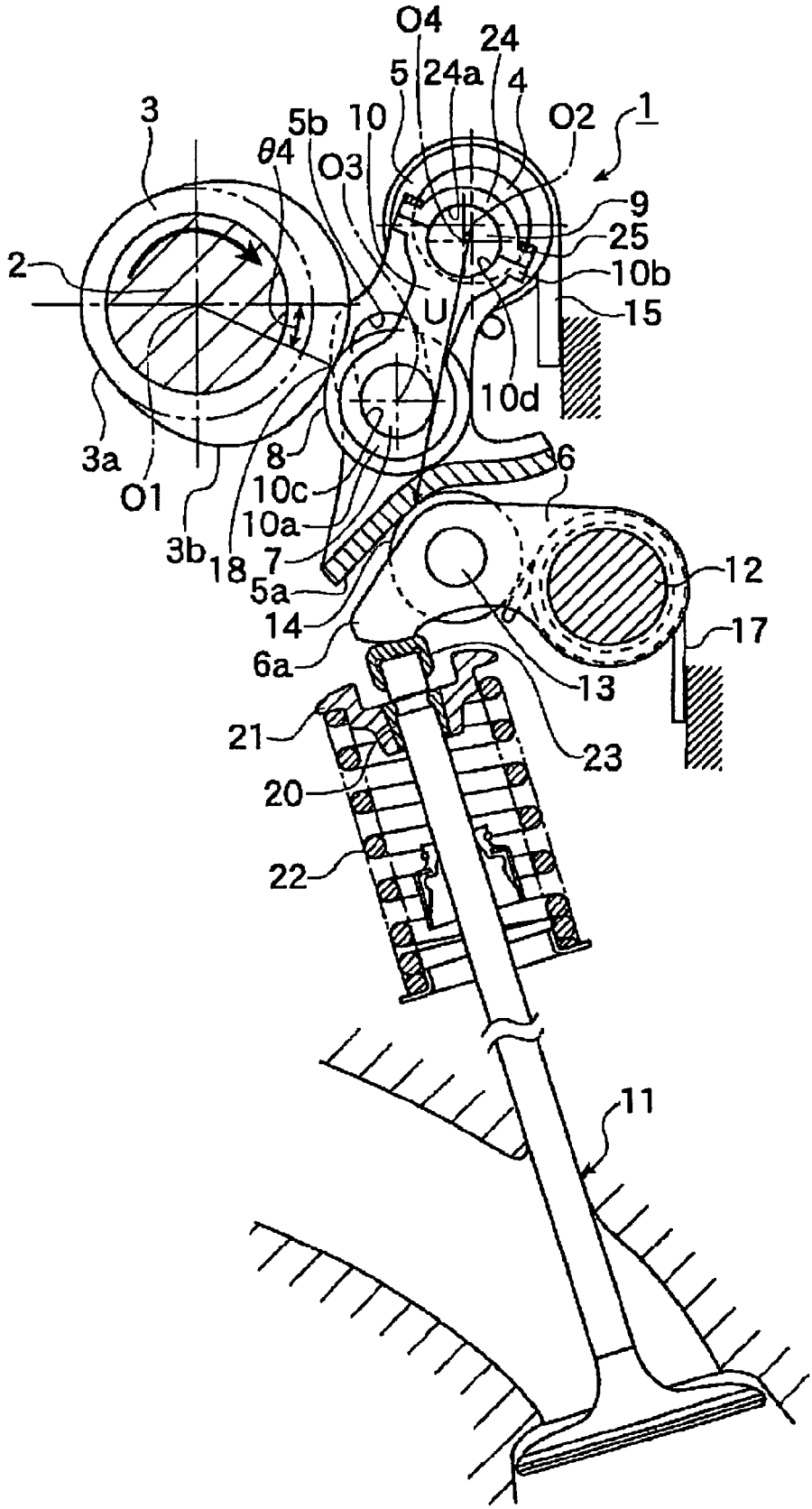
FIG. 13 is a side elevational and partial sectional view of a portion of the variable valve train mechanism of FIG. 10, the illustrated state of the mechanism corresponds to when the smallest lift is desired, when the intake valve being opened.

FIG. 12 is a vertical sectional view of a portion of the variable valve train mechanism of an internal combustion engine arranged in a mode for providing the smallest valve lift, and shows the intake valve being closed. FIG. 13 is another vertical sectional view of the variable valve train mechanism, in the smallest valve lift mode and shows a state of the intake valve being opened.

As shown in FIG. 12, the roller shaft 7 can be first displaced to the end of the guide portion 5*b* on the rocker arm 6 side from the end of the guide portion 5*b* on the swing shaft 4 side, at which the roller shaft 7 can be held in FIG. 10, to change the relative distance between the center axis O2 of the swing shaft 4 and the roller 8. For example, the swing shaft 4 can be rotated by the actuator within the range of a specified angle to displace the drive shaft 9 along the circumferential direction of the swing shaft 4.

This causes the roller shaft 7 to be rotated through the arm 10 and displaced from the end of the guide portion 5*b* on the swing shaft 4 side to the end of the guide portion 5*b* on the rocker arm 6 side, so that the relative distance between the center axis O2 of the swing shaft 4 and the roller 8 can be changed. Then, the angle 3 between the horizontal direction from the center axis O1 of the camshaft 2 and the relative direction from the center axis O1 of the camshaft 2 to the contact point 18 as shown in FIGS. 10 and 11 can be increased to the angle 4 as shown in FIGS. 12 and 13. Also, the swing cam 5 can be urged from its position as shown in FIG. 10 toward the rotational cam 3 by the urging force of the spring 15, as shown in FIG. 12, and the cam face 5*a* of the swing cam 5 can be swung toward the rotational cam 3.

As shown in FIG. 12, when the roller 8 on the swing cam 5 is in contact with the base face 3*a* of the rotational cam 3 by means of the spring 15, the swing cam 5 is not swung toward the intake valve 11. Also, the rocker arm 6 can be urged toward the swing cam 5 by the urging force of the spring 17, and the intake valve 11 can be urged toward a valve seat by the urging force of the valve spring 22. Thus, no lift of the intake valve 11 occurs and the intake valve 11 can be in a closed state. At this time as well, a valve clearance can be present between the shim 23 and the rocker arm 6.

Then, when the rotational cam 3 is rotationally driven through the camshaft 2 in connection with the rotation of the crankshaft of the internal combustion engine, the roller 8 can be depressed with the nose face 3*b* as shown in FIG. 13. When the roller 8 is depressed, the swing cam 5 can be also depressed through the roller shaft 7 and swung counterclockwise in FIG. 12 against the urging force of the spring 15. Additionally, as shown in FIGS. 12 and 13, the angle 4 between the horizontal direction from the center axis O1 of the camshaft 2 and the relative direction from the center axis O1 of the camshaft 2 to the contact point 18 can be larger than the angle 3, at which the largest lift is desired, as described above. Thus, the position of the swing cam 5 at which the swing cam 5 starts swinging is retarded.

When the swing cam 5 is swung, the swing cam 5 depresses the roller 14 in contact with the end of the cam face 5*a* of the swing cam 5 on the swing shaft 4 side toward the intake valve 11 using the area from the end of the cam face 5*a* on the swing shaft 4 side to the central portion of the cam face 5*a* (small lift zone a), and then the rocker arm 6 can be swung toward the intake valve 11 through the roller shaft 13. Incidentally, the rocker arm 6 is not swung while the roller 14 is moving along the idle running zone c of the small lift zone a.

In such manner, as the relative distance between the center axis O2 of the swing shaft 4 and the roller 14 in contact with the cam face 5*a* of the swing cam 5 can be reduced from the relative distance T as shown in FIG. 12 to the relative distance U as shown in FIG. 13, the rocker arm 6 can be swung toward the intake valve by a smaller amount.

Then, the rocker arm 6 is swung toward the intake valve 11 by a smaller amount depresses the top face of the shim 23 with the depressing portion 6*a* formed at its end, to depress the intake valve 11 by a smaller amount. As described above, when the roller shaft 7 is displaced to the end of the guide portion 5*b* on the rocker arm 6 side to change the relative distance between the center axis O2 of the swing shaft 4 and the roller 8, the relative distance from the center axis O2 of the swing shaft 4 to the roller 14 in contact with the cam face 5*a* of the swing cam 5 can be reduced, so that the intake valve 11 can be depressed by a smaller amount. As a result, the intake valve 11 can be opened with the smallest lift, as shown in FIG. 9 by the phantom line D.

Further, in this embodiment, when the roller shaft 7 is displaced to the end of the guide portion 5*b* on the rocker arm 6 side to depress the intake valve 11, a valve opening becomes small. However, since the relative distance between the center axis O2 of the swing shaft 4 and the roller 8 in contact with the nose face 3*b* can be increased, and a lever ratio of the swing cam can be reduced, a smaller lift than in the small opening duration in the embodiments of FIGS. 1-4 can be obtained.

Further, when the roller shaft 7 is displaced to the end of the guide portion 5*b* on the rocker arm 6 side so that the relative distance between the center axis O2 of the swing shaft 4 and the roller 8 is changed, the angle 4 between the horizontal direction from the center axis O1 of the camshaft 2 and the relative direction from the center axis O1 of the camshaft 2 to the contact point 18 can be increased as shown in FIGS. 12 and 13. Thus, as shown in FIG. 9, there is caused a difference of angle F between a cam angle at the time of a maximum lift on the straight line Z, which shows the largest lift, and a cam angle at the time of a maximum lift on the phantom line D, which shows the smallest lift in the Embodiment of FIGS. 10-14, and the timing of the maximum lift is retarded by such difference of angle F.

Further, when the roller shaft 7 is displaced to the central portion of the guide portion 5*b* to change the relative distance between the center axis O2 of the swing shaft 4 and the roller 8, the timing of a maximum lift and a lift as shown in FIG. 9 by the dashed line B are obtained.

For example, when the roller shaft 7 is displaced to the central portion of the guide portion 5*b*, the angle between the horizontal direction from the center axis O1 of the camshaft 2 and the relative direction from the center axis O1 of the camshaft 2 to the contact point 18 becomes larger than the angle 3, at which the lift can be the largest as shown in FIGS. 10 and 11.

Thus, as shown in FIG. 9, there can be caused a difference of angle H between a cam angle at the time of a maximum lift on the straight line Z, which shows the largest lift, and a cam angle at the time of a maximum lift on the dashed line B, and the timing of the maximum lift is retarded by such difference of angle H.

Also, since the angle between the horizontal direction from the center axis O1 of the camshaft 2 and the relative direction from the center axis O1 of the camshaft 2 to the contact point 18 can be smaller than the angle 4, at which the lift can be the smallest as shown in FIGS. 12 and 13, the timing of a maximum lift can be earlier than when the lift can be the smallest as shown in FIG. 9 by the phantom line D. Meanwhile, the lift can be an intermediate value between the largest lift and the smallest lift.

As seen in the foregoing, as the roller shat 7 is displaced to the end of the guide portion 5*b* on the rocker arm 6 side to change the relative distance between the center axis O2 of the swing shaft 4 and the roller 8, the lift is reduced and the timing of the maximum lift is retarded in the order of the continuous line Z, dashed line B and phantom line D in FIG. 9, with reference to the timing of the maximum lift when the roller shaft 7 can be displaced to the end of the guide portion 5*b* on the swing shaft 4 side in the embodiments of FIGS. 10-14, namely, when the largest lift can be obtained.

As with the embodiment of FIGS. 1-4, in the variable valve train mechanism 1 of an internal combustion engine constituted in accordance with the present embodiment, changing the relative distance between the center axis O2 of the swing shaft 4 and the roller 8 allows changing a lift and the timing of a maximum lift as shown in FIG. 9. The rest of the configuration and function can be the same as with the embodiment of FIGS. 1-4, and redundant description is not repeated.

Figure 14:
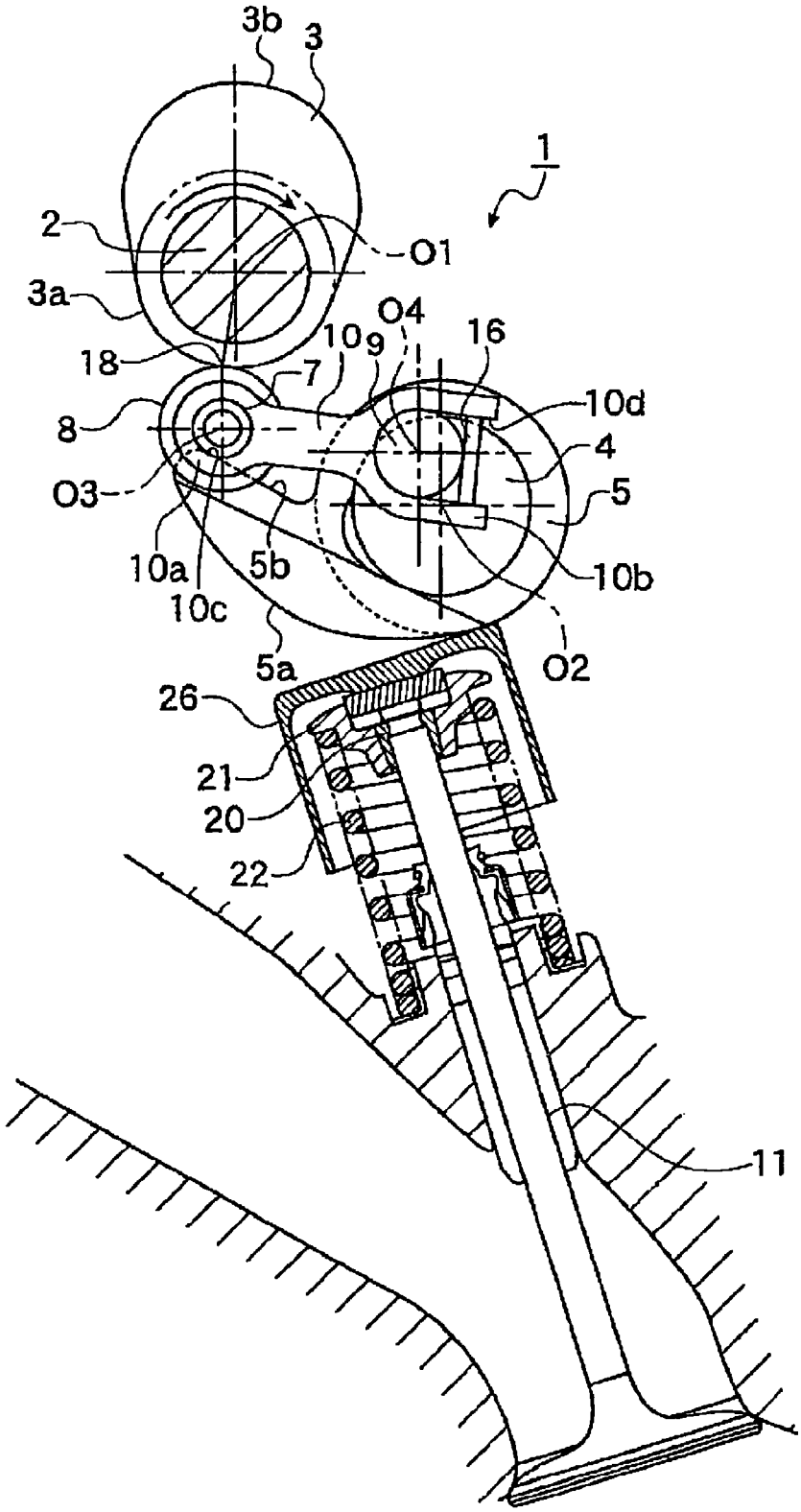
FIG. 14 is a side elevational and partial sectional view of a portion of a variable valve train mechanism in accordance with another modification of the mechanism of FIG. 1, the illustrated state of the mechanism corresponds to when the largest lift is required, with an intake valve being closed.
Figure 15:
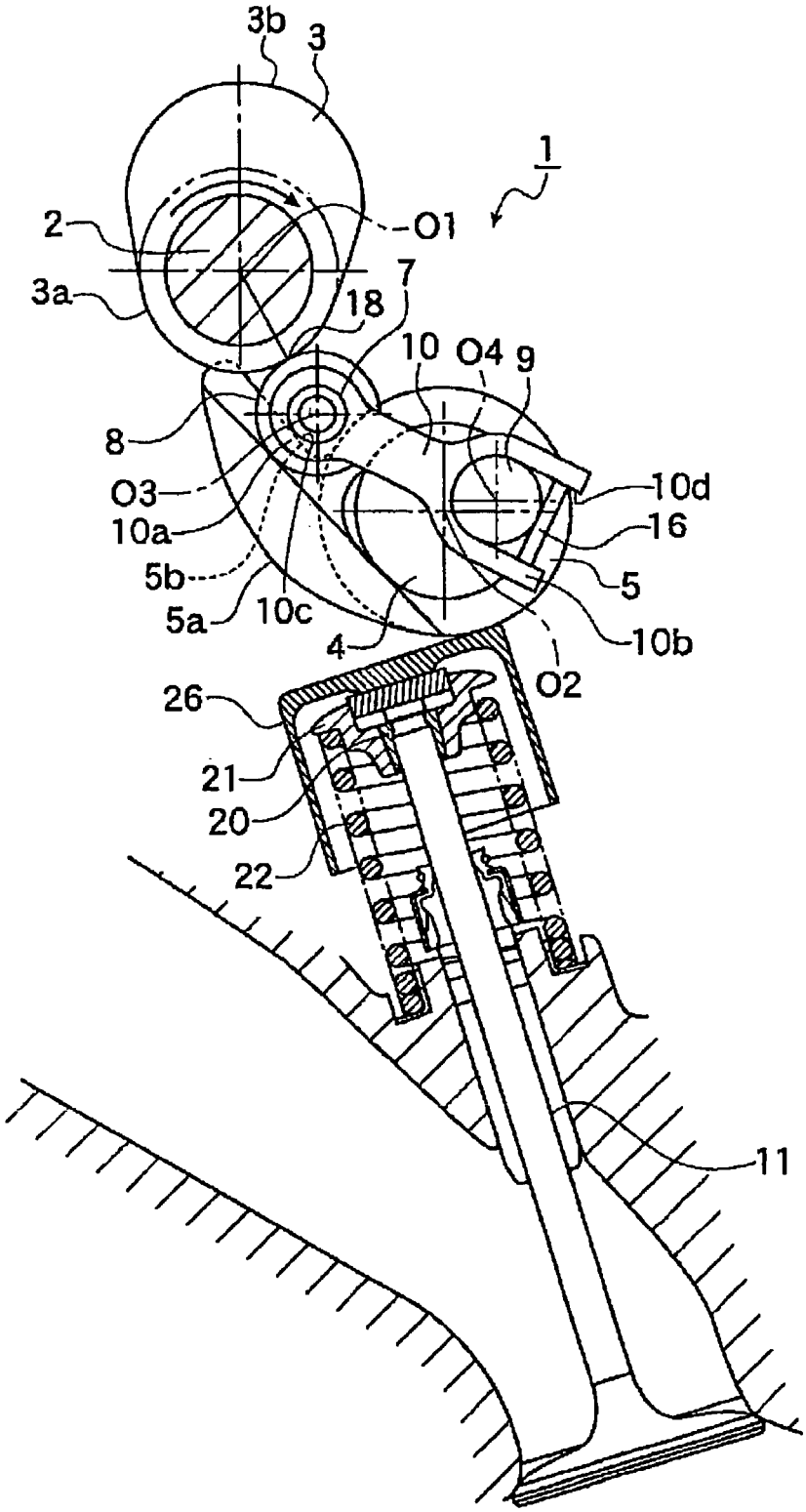
FIG. 15 is a side elevational and partial sectional view of a portion of the variable valve train mechanism of FIG. 14, the illustrated state of the mechanism corresponds to when the smallest valve lift is desired, with the intake valve being closed.

FIG. 14 is a vertical sectional view of a portion of a variable valve train mechanism arranged in a mode for providing the largest valve lift and showing the intake valve being closed. FIG. 15 is another vertical sectional view of the variable valve train mechanism in the largest valve lit mode, and showing the intake valve being closed.

In this embodiment, there is no rocker arm. Rather, a swing cam 5 directly moves the intake valve 11 upwardly and downwardly between opened and closed positions.

As shown in FIGS. 14 and 15, the swing cam 5 can be formed in the shape of a comma-shaped bead in side view. The swing cam 5 can be fitted on the peripheral surface of a swing shaft 4 and swingably supported about a center axis O2 of the swing shaft 4.

For example, in some embodiments, the bottom face of the swing cam 5 can be formed with a cam face 5*a*. The cam face 5*a* can be curved toward the intake valve 11 to form a projection, and can be configured to depress a lifter 26 of the intake valve 11 to move the intake valve 11 upwardly and downwardly. The upper portion of the cam face 5*a* can be formed with a guide portion 5*b*, along which a roller shaft 7, which can have a roller 8, slides.

An arm 10 can be connected to a drive shaft 9, and the roller shaft 7 connected to one end 10*a* of the arm 10 can be disposed between a rotational cam 3 and the guide portion 5*b* of the swing cam 5.

The swing shaft 4 can be provided with a spring (not shown) configured to urge the swing cam 5 toward the rotational cam 3. The swing cam 5 can be thereby urged toward the rotational cam 3 by the urging force of the spring, so that the peripheral surface of the roller shaft 7 can be normally in contact with the guide portion 5*b*, and the peripheral surface of the roller 8 can be normally in contact with a base face 3*a* or a nose face 3*b* of the rotational cam 3 during operation.

There can be provided, below the cam face 5*a* of the swing cam 5, the lifter 26 attached on the intake valve 11. Thus, the swinging motion of the swing cam 5 can directly move the intake valve 11 upwardly and downwardly.

Thus, when the swing shaft 4 is rotationally driven by a specified angle by an actuator (not shown), the drive shaft 9 formed in the swing shaft 4 can be rotated by a specified angle about the center axis O2 of the swing shaft 4. Then, the roller shaft 7 can be rotated through the arm 10 in connection with the drive shaft 9. The roller shaft 7 can be then displaced along the guide portion 5*b* while keeping a certain distance between a center axis O3 of the roller shaft 7 and a center axis O4 of the drive shaft 9 by means of the arm 10, so that a relative distance between the center axis O2 of the swing shaft 4 and the roller 8 is changed. This allows controlling to change a lift and the timing of a maximum lift of the intake valve 11.

As shown in FIG. 14, when the roller shaft 7 is displaced to the end of the guide portion 5*b* so that the relative distance between the center axis O2 of the swing shaft 4 and the roller 8 can be changed, the intake valve 11 can be depressed with the cam face 5*a* of the swing cam 5 by a larger amount. The valve lift thus becomes the largest in this mode.

As shown in FIG. 15, when the roller shaft 7 is displaced to a portion of the guide portion 5*b* on the swing shaft 4 side so that the relative distance between the center axis O2 of the swing shaft 4 and the roller 8 is changed, the intake valve 11 can be depressed with the cam face 5*a* of the swing cam 5 by a smaller amount. The valve lift thus becomes the smallest in this mode.

As with the Embodiments of FIGS. 1-4 and 10-13, in the present embodiment, changing the relative distance between the center axis O2 of the swing shaft 4 and the roller 8 allows changing a lift and the timing of a maximum lift. Further, since the intake valve 11 can be moved upwardly and downwardly directly by the swing cam 5, manufacturing cost can be reduced.

The rest of the configuration and function can be the same as with the embodiments of FIGS. 1-4 and 10-13, and redundant description is not repeated.

Figure 16:
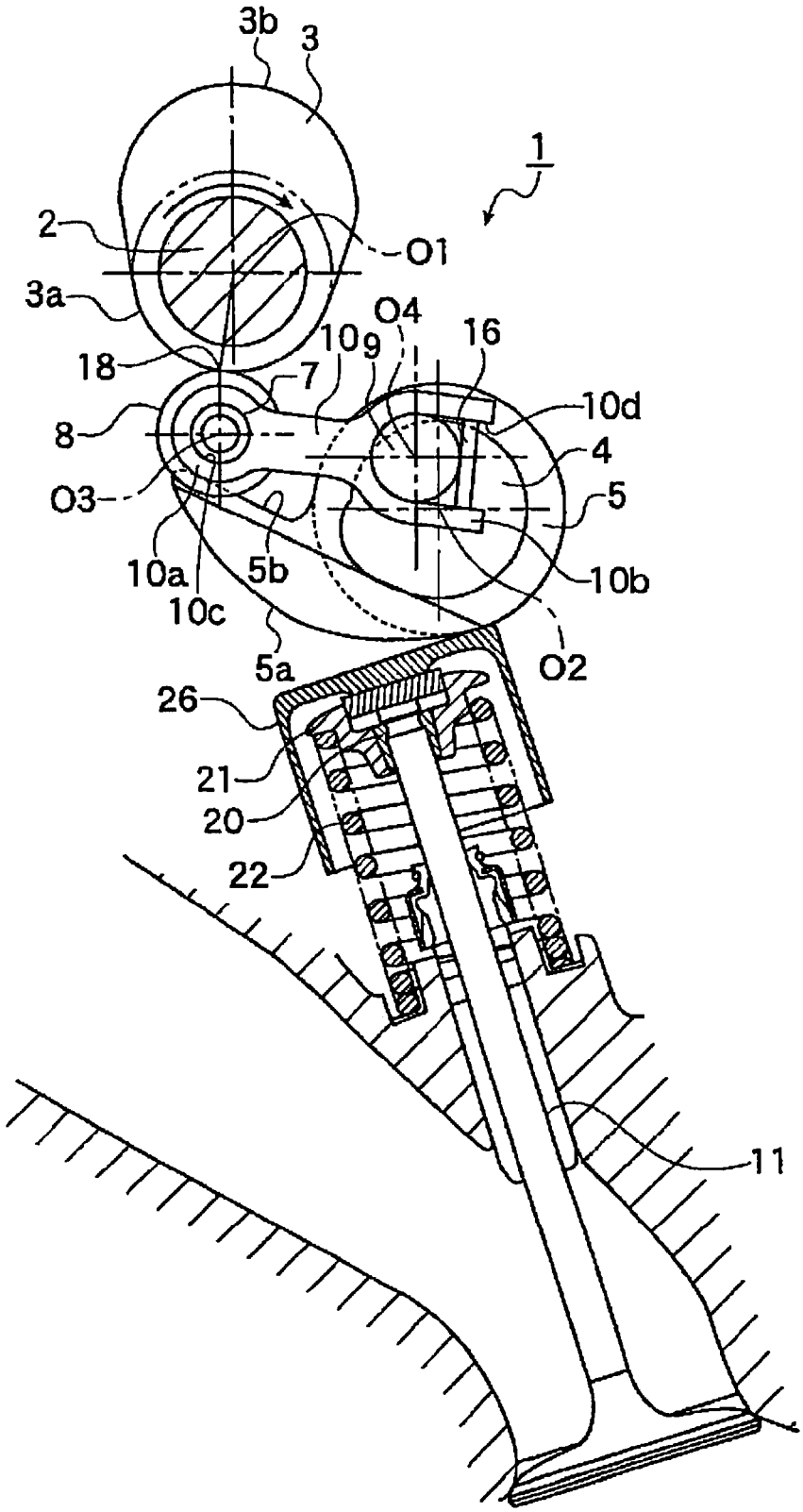
FIG. 16 is a side elevational and partial sectional view of a portion of a variable valve train mechanism in accordance with yet another modification of the mechanism of FIG. 1, the illustrated state of the mechanism corresponds to when the largest valve lift is desired, with an intake valve being closed.
Figure 17:
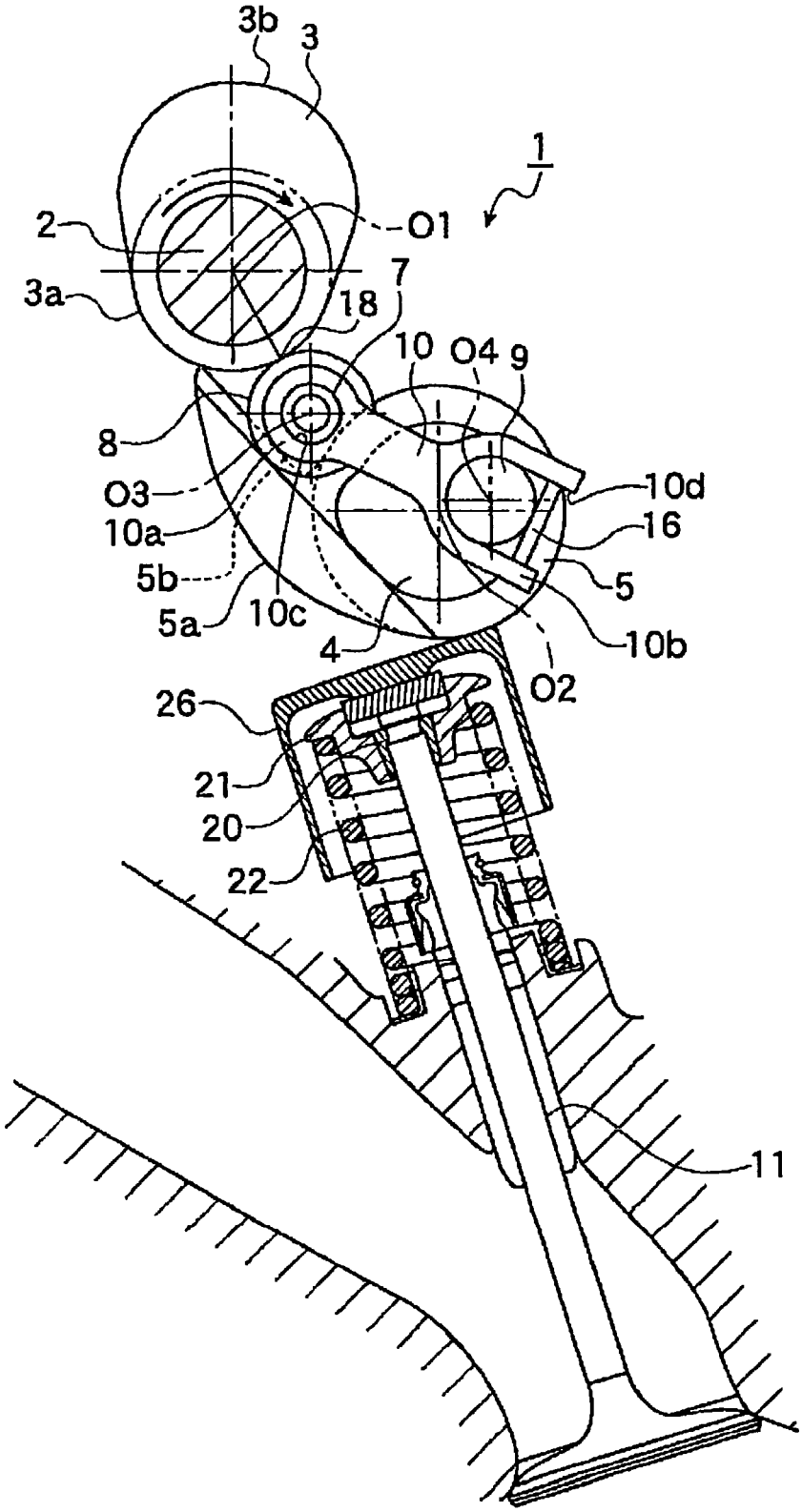
FIG. 17 is a side elevational and partial sectional view of a portion of the variable valve train mechanism of FIG. 16, the illustrated state of the mechanism corresponds to when the smallest valve lift is desired, with the intake valve being closed.

FIGS. 16 and 17 illustrate yet another embodiment FIG. 16 is a vertical sectional view of a portion of a variable valve train mechanism of an internal combustion engine, arranged in a mode for providing the largest valve lift, and shows the intake valve being closed. FIG. 17 is another vertical sectional view of a portion of the variable valve train mechanism, in the smallest valve lift mode, and showing the state of the intake valve being closed.

As compared to the embodiment of FIGS. 14 and 15, in which the peripheral surface of the roller shaft 7 is made to contact the guide portion 5*b* of the swing cam 5, an end 10*a* of an arm 10 is in sliding contact with a guide portion 5*b* of a swing cam 5.

With this configuration, as a swing shaft 4 can be rotated, for example, from the state shown in FIG. 16 to the state shown in FIG. 17, the end 10*a* of the arm 10 slides along the guide portion 5*b* of the swing cam 5. A relative distance between a roller 8 and a center axis O2 of the swing shaft 4 can be thus changed, thereby controlling a lift.

The rest of the configuration and function can be the same as with the embodiments of FIGS. 14-15, and redundant description is not repeated.

Figure 18:
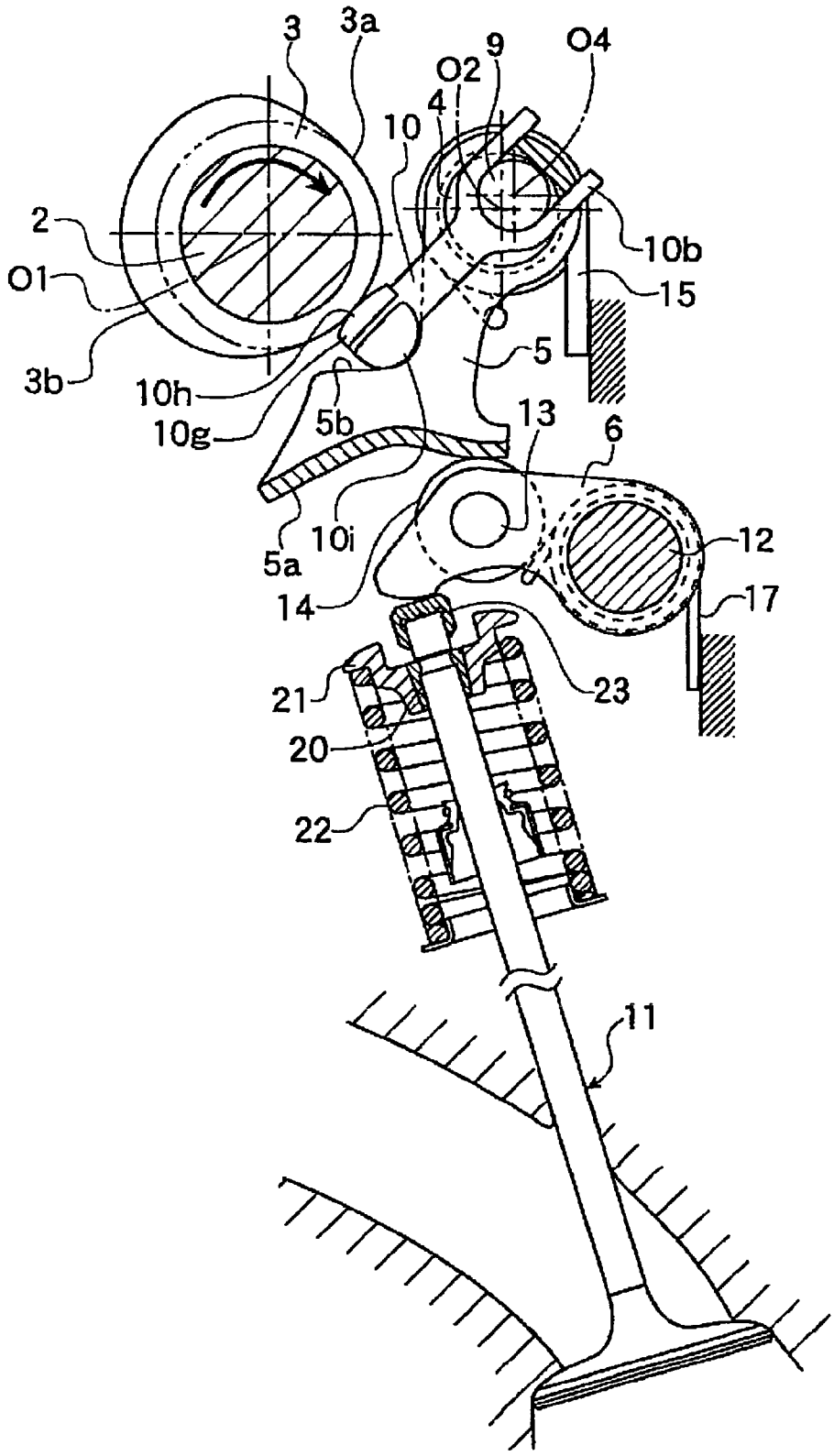
FIG. 18 is a side elevational and partial sectional view of a portion of a variable valve train mechanism in a further modification of the mechanism of FIG. 1, with an intake valve being closed.

FIG. 18 shows a further embodiment the variable valve mechanism. As compared to the embodiments of FIGS. 1-4, in which the "rotational cam abutment portion" is the roller 8, a "slipper portion" 10*g* is used in the present embodiment for providing he same function. Further, in the embodiments of FIGS. 1-4, the guide portion 5*b* has the shape of a slot, but in the present embodiment, a guide portion 5*b* can be an inclined surface formed by cutting away a portion of a swing cam 5.

The slipper portion 10*g* can be formed at the end of an arm 10 and has abutment surfaces 10*h* and 10*i*. One abutment surface 10*h* can be in sliding contact with a rotational cam 3, and the other abutment surface 10*i* can be in sliding contact with the guide portion 5*b* of the swing cam 5.

With such configuration, when the swing shaft 4 can be rotated, the arm 10 causes the slipper portion 10*g* to slide along the guide portion 5*b*, so that a relative distance between the slipper portion 10*g* and a center axis O2 of the swing shaft 4 can be changed.

Providing the slipper portion 10*g* in such manner, in place of the roller 8, can simplify the structure. The rest of the configuration and function of the present embodiment can be the same as with the embodiment of FIGS. 1-4, and thus a redundant description is not repeated.

Figure 19:
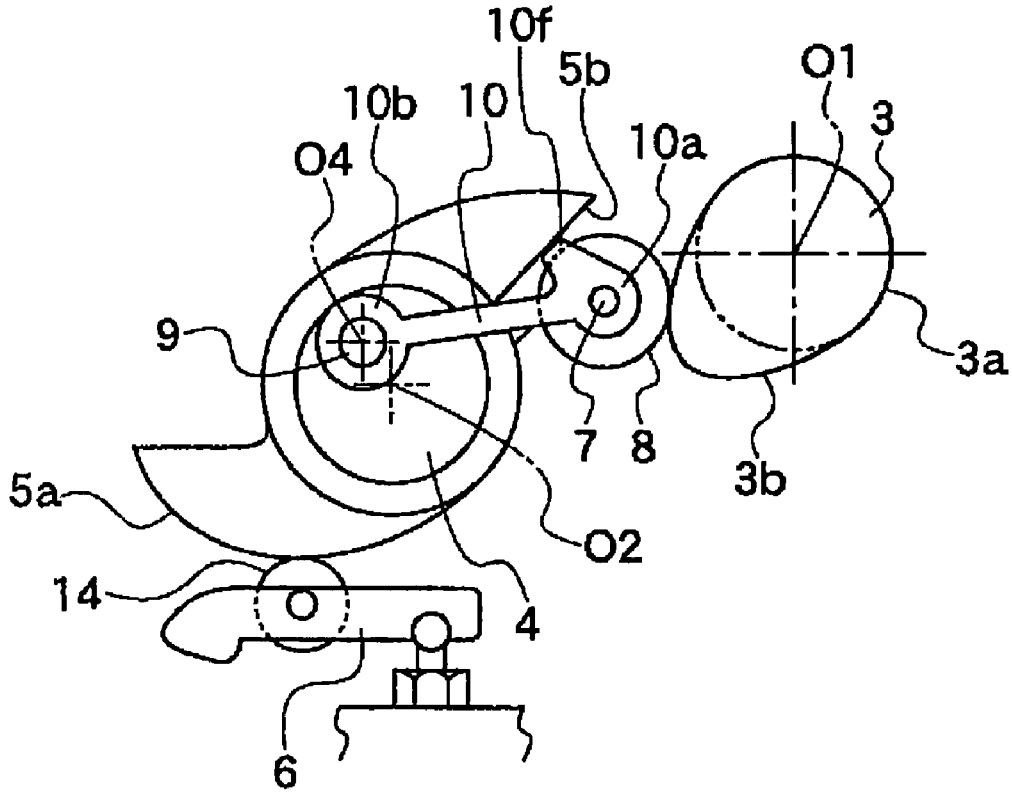
FIG. 19 is a schematic view of a variable valve train mechanism of an internal combustion engine in accordance with a different modification of the mechanism of FIG. 1.

FIG. 19 shows yet another embodiment of the variable valve mechanism. In this embodiment, a rocker-arm-type swing cam 5 can be rotatably provided on a swing shaft 4, to which a drive shaft 9 can be fixed. The swing shaft 4 can have a center axis O2, and the drive shaft 9 can have a center axis O4.

The swing shaft 4 can be provided with the rotatable swing cam 5. An arm 10 can have one end 10*a* provided with a rotatable roller 8 through a roller shaft 7, and the other end 10*b* can be rotatably provided on the drive shaft 9. The roller 8 can be in abutment with a rotational cam 3, and a projection 10*f* formed on the one end 10*a* of the arm 10 can be in sliding contact with a guide portion 5*b* of the swing cam 5.

The swing cam 5 can have a cam face 5*a* opposite the guide portion 5*b* with respect to the swing shaft 4, and the cam face 5*a* can be in abutment with a roller 14 of a rocker arm 6.

With such configuration, when the rotational cam 3 is rotated in a certain direction, the roller 8 can be depressed by the rotational cam 3, and the depressing force of the rotational cam 3 can be transmitted to the guide portion 5*b* of the swing cam 5 via the one end 10*a* of the arm 10.

The swing cam 5 can be thereby rotated about the swing shaft 4, and then the roller 14 of the rocker arm 6 can be depressed and swung by the cam face 5*a*, so that a valve (not shown) is opened and closed.

In the case of controlling a lift, the swing shaft 4 can be rotated by a specified amount so that the eccentric drive shaft 9 can be rotated about the center axis O2 of the swing shaft 4. Then, the one end 10*a* of the arm 10 slides along the guide portion 5*b* of the swing cam 5, and then the roller 8 can be guided in a certain direction.

Guiding the roller 8 in a certain direction in such manner allows changing a valve lift and the like.

Also in this configuration, since a load from the rotational cam 3 can be transmitted to the guide portion 5*b* of the swing cam 5 via the roller 8 and the one end 10*a* of the arm 10, no large bending moment acts on the entire arm 10. Thus, there is no need to significantly increase the strength of the arm 10.

The rest of the configuration and function can be the same as with the embodiments of FIGS. 1-4, and thus a redundant description is not repeated.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A variable valve train mechanism of an internal combustion engine, configured to change a lift of an intake valve or an exhaust valve of the internal combustion engine, the variable valve train mechanism comprising:

a camshaft rotationally driven by a crankshaft of the internal combustion engine, a rotational cam disposed on the camshaft;

a swing shaft disposed parallel to the camshaft, and a swing cam supported with the swing shaft and being swingable with a movement of the rotational cam, wherein the swing cam has a movable rotational cam abutment portion which contacts the rotational cam and transmits driving force from the rotational cam to the swing cam, and a guide portion for guiding the rotational cam abutment portion in a certain direction, the swing cam being configured to input the driving force from the rotational cam is to the guide portion via the rotational cam abutment portion so that the swing cam is swung with a movement of the rotational cam, the swing cam also comprising a contoured cam face;

an abutment portion displacing mechanism configured to displace the rotational cam abutment portion along the guide portion so as to change a relative distance between the rotational cam abutment portion and a center axis of the swing shaft, the abutment portion displacing mechanism comprising a drive shaft formed continuously from the swing shaft along its axial direction and having a center axis parallel to and eccentric from the center axis of the swing shaft, and an arm with one end connected to the rotational cam abutment portion and the other end connected to the drive shaft; and a rocker arm that is configured to be swung by the swing cam and a spring configured to urge the rocker arm toward the swing cam, the rocker arm having a follower configured to contact the contoured cam face of the swing cam;

wherein as the swing shaft is rotated to displace the drive shaft around the center axis of the swing shaft, the rotational cam abutment portion is displaced through the arm, so that the relative distance between the rotational cam abutment portion and the center axis of the swing shaft is changed and a relative position of the follower and the contoured face is changed, whereby a lift of the valve is changed;

wherein the guide portion is configured to allow the swing cam to swing through a range of orientations corresponding to a large lift zone, a small lift zone, and an idle running zone which overlaps with both of the large and small.

2. The variable valve train mechanism of an internal combustion engine according to claim 1, wherein the guiding direction of the guide portion is inclined relative to the radial direction of the camshaft.

3. The variable valve train mechanism of an internal combustion engine according to claim 1, wherein the guide portion is a slot.

4. The variable valve train mechanism of an internal combustion engine according to claim 1, wherein the guide portion is an inclined surface formed on a side of the swing cam on the rotational cam side.

5. The variable valve train mechanism of an internal combustion engine according to claim 1, wherein the rotational cam abutment portion comprises a roller supported with a roller shaft having a center axis parallel to the center axis of the swing shaft, and the rotational cam abutment portion is supported at one end of the arm through the roller shaft.

6. The variable valve train mechanism of an internal combustion engine according to claim 5, wherein one end of the arm closer to the roller shaft is in sliding contact with the guide portion.

7. The variable valve train mechanism of an internal combustion engine according to claim 1, wherein the swing shaft is urged toward the rotational cam by a spring.

8. The variable valve train mechanism of an internal combustion engine according to claim 1, wherein one end of the swing cam is provided with an actuator for rotationally driving the swing shaft within the range of a specified angle.

9. The variable valve train mechanism of an internal combustion engine according to claim 1, wherein a cam face of the swing cam is formed with a concentric arcuate idle running zone centered on the center axis of the swing shaft.

10. A variable valve train mechanism of an internal combustion engine, configured to change a lift of an intake valve or an exhaust valve of the internal combustion engine, the variable valve train mechanism comprising:

a camshaft rotationally driven by a crankshaft of the internal combustion engine, a rotational cam disposed on the camshaft;

a swing shaft disposed parallel to the camshaft, and a swing cam supported with the swing shaft and being swingable with a movement of the rotational cam, wherein the swing cam has a movable rotational cam abutment portion which contacts the rotational cam and transmits driving force from the rotational cam to the swing cam, and a guide portion for guiding the rotational cam abutment portion in a certain direction, the swing cam being configured to input the driving force from the rotational cam is to the guide portion via the rotational cam abutment portion so that the swing cam is swung with a movement of the rotational cam, the swing cam also comprising a contoured cam face;

an abutment portion displacing mechanism configured to displace the rotational cam abutment portion along the guide portion so as to change a relative distance between the rotational cam abutment portion and a center axis of the swing shaft, the abutment portion displacing mechanism comprising a drive shaft formed continuously from the swing shaft along its axial direction and having a center axis parallel to and eccentric from the center axis of the swing shaft, and an arm with one end connected to the rotational cam abutment portion and the other end connected to the drive shaft; and a rocker arm that is configured to be swung by the swing cam and a spring configured to urge the rocker arm toward the swing cam, the rocker arm having a follower configured to contact the contoured cam face of the swing cam;

wherein as the swing shaft is rotated to displace the drive shaft around the center axis of the swing shaft, the rotational cam abutment portion is displaced through the arm, so that the relative distance between the rotational cam abutment portion and the center axis of the swing shaft is changed and a relative position of the follower and the contoured face is changed, whereby a lift of the valve is changed; and wherein the drive shaft is formed in a manner such that its peripheral edge is within the peripheral edge of the swing shaft, as seen in the axial direction.

11. A variable valve train mechanism of an internal combustion engine, configured to change a lift of an intake valve or an exhaust valve of the internal combustion engine, the variable valve train mechanism comprising:

a camshaft rotationally driven by a crankshaft of the internal combustion engine, a rotational cam disposed on the camshaft;

a swing shaft disposed parallel to the camshaft, and a swing cam supported with the swing shaft and being swingable with a movement of the rotational cam, wherein the swing cam has a movable rotational cam abutment portion which contacts the rotational cam and transmits driving force from the rotational cam to the swing cam, and a guide portion for guiding the rotational cam abutment portion in a certain direction, the swing cam being configured to input the driving force from the rotational cam is to the guide portion via the rotational cam abutment portion so that the swing cam is swung with a movement of the rotational cam, the swing cam also comprising a contoured cam face;

an abutment portion displacing mechanism configured to displace the rotational cam abutment portion along the guide portion so as to change a relative distance between the rotational cam abutment portion and a center axis of the swing shaft, the abutment portion displacing mechanism comprising a drive shaft formed continuously from the swing shaft along its axial direction and having a center axis parallel to and eccentric from the center axis of the swing shaft, and an arm with one end connected to the rotational cam abutment portion and the other end connected to the drive shaft; and a rocker arm that is configured to be swung by the swing cam and a spring configured to urge the rocker arm toward the swing cam, the rocker arm having a follower configured to contact the contoured cam face of the swing cam;

wherein as the swing shaft is rotated to displace the drive shaft around the center axis of the swing shaft, the rotational cam abutment portion is displaced through the arm, so that the relative distance between the rotational cam abutment portion and the center axis of the swing shaft is changed and a relative position of the follower and the contoured face is changed, whereby a lift of the valve is changed; and wherein the other end of the arm is formed with a fitting recess in which the drive shaft is rotatably fitted, and a coming-off prevention member is provided, on the side of an open end of the fitting recess, the coming-off prevention member being configured to prevent the drive shaft from coming off toward the open end.

12. A variable valve train mechanism of an internal combustion engine, configured to change a lift of an intake valve or an exhaust valve of the internal combustion engine, the variable valve train mechanism comprising:

a camshaft rotationally driven by a crankshaft of the internal combustion engine, a rotational cam disposed on the camshaft;

a swing shaft disposed parallel to the camshaft, and a swing cam supported with the swing shaft and being swingable with a movement of the rotational cam, wherein the swing cam has a movable rotational cam abutment portion which contacts the rotational cam and transmits driving force from the rotational cam to the swing cam, and a guide portion for guiding the rotational cam abutment portion in a certain direction, the swing cam being configured to input the driving force from the rotational cam is to the guide portion via the rotational cam abutment portion so that the swing cam is swung with a movement of the rotational cam, the swing cam also comprising a contoured cam face;

an abutment portion displacing mechanism configured to displace the rotational cam abutment portion along the guide portion so as to change a relative distance between the rotational cam abutment portion and a center axis of the swing shaft, the abutment portion displacing mechanism comprising a drive shaft formed continuously from the swing shaft along its axial direction and having a center axis parallel to and eccentric from the center axis of the swing shaft, and an arm with one end connected to the rotational cam abutment portion and the other end connected to the drive shaft; and a rocker arm that is configured to be swung by the swing cam and a spring configured to urge the rocker arm toward the swing cam, the rocker arm having a follower configured to contact the contoured cam face of the swing cam;

wherein as the swing shaft is rotated to displace the drive shaft around the center axis of the swing shaft, the rotational cam abutment portion is displaced through the arm, so that the relative distance between the rotational cam abutment portion and the center axis of the swing shaft is changed and a relative position of the follower and the contoured face is changed, whereby a lift of the valve is changed;

wherein the rotational cam abutment portion comprises a roller supported with a roller shaft having a center axis parallel to the center axis of the swing shaft, and the rotational cam abutment portion is supported at one end of the arm through the roller shaft; and wherein the roller shaft is in sliding contact with the guide portion.

13. A variable valve train mechanism of an internal combustion engine, configured to change a lift of an intake valve or an exhaust valve of the internal combustion engine, the variable valve train mechanism comprising:

a camshaft rotationally driven by a crankshaft of the internal combustion engine, a rotational cam disposed on the camshaft;

a swing shaft disposed parallel to the camshaft, and a swing cam supported with the swing shaft and being swingable with a movement of the rotational cam, wherein the swing cam has a movable rotational cam abutment portion which contacts the rotational cam and transmits driving force from the rotational cam to the swing cam, and a guide portion for guiding the rotational cam abutment portion in a certain direction, the swing cam being configured to input the driving force from the rotational cam is to the guide portion via the rotational cam abutment portion so that the swing cam is swung with a movement of the rotational cam, the swing cam also comprising a contoured cam face;

an abutment portion displacing mechanism configured to displace the rotational cam abutment portion along the guide portion so as to change a relative distance between the rotational cam abutment portion and a center axis of the swing shaft, the abutment portion displacing mechanism comprising a drive shaft formed continuously from the swing shaft along its axial direction and having a center axis parallel to and eccentric from the center axis of the swing shaft, and an arm with one end connected to the rotational cam abutment portion and the other end connected to the drive shaft; and a rocker arm that is configured to be swung by the swing cam and a spring configured to urge the rocker arm toward the swing cam, the rocker arm having a follower configured to contact the contoured cam face of the swing cam;

wherein as the swing shaft is rotated to displace the drive shaft around the center axis of the swing shaft, the rotational cam abutment portion is displaced through the arm, so that the relative distance between the rotational cam abutment portion and the center axis of the swing shaft is changed and a relative position of the follower and the contoured face is changed, whereby a lift of the valve is changed; and wherein the rotational cam abutment portion is a slipper portion which slides on the rotational cam.

14. A variable valve train mechanism of an internal combustion engine, configured to change a lift of an intake valve or an exhaust valve of the internal combustion engine, the variable valve train mechanism comprising:

a camshaft rotationally driven by a crankshaft of the internal combustion engine, a rotational cam disposed on the camshaft;

a swing shaft disposed parallel to the camshaft, and a swing cam supported with the swing shaft and being swingable with a movement of the rotational cam, wherein the swing cam has a movable rotational cam abutment portion which contacts the rotational cam and transmits driving force from the rotational cam to the swing cam, and a guide portion for guiding the rotational cam abutment portion in a certain direction, the swing cam being configured to input the driving force from the rotational cam is to the guide portion via the rotational cam abutment portion so that the swing cam is swung with a movement of the rotational cam, the swing cam also comprising a contoured cam face;

an abutment portion displacing mechanism configured to displace the rotational cam abutment portion along the guide portion so as to change a relative distance between the rotational cam abutment portion and a center axis of the swing shaft, the abutment portion displacing mechanism comprising a drive shaft formed continuously from the swing shaft along its axial direction and having a center axis parallel to and eccentric from the center axis of the swing shaft, and an arm with one end connected to the rotational cam abutment portion and the other end connected to the drive shaft; and a rocker arm that is configured to be swung by the swing cam and a spring configured to urge the rocker arm toward the swing cam, the rocker arm having a follower configured to contact the contoured cam face of the swing cam;

wherein as the swing shaft is rotated to displace the drive shaft around the center axis of the swing shaft, the rotational cam abutment portion is displaced through the arm, so that the relative distance between the rotational cam abutment portion and the center axis of the swing shaft is changed and a relative position of the follower and the contoured face is changed, whereby a lift of the valve is changed; and wherein in the abutment portion displacing mechanism, the swing shaft is rotated about 180 degrees between a small lift setting state and a large lift setting state, and in each setting state, a straight line which connects the center axis of the swing shaft and the center axis of the drive shaft extends generally along the direction of extension of the arm.

15. A variable valve train mechanism of an internal combustion engine, comprising a camshaft rotationally driven by a crankshaft of the internal combustion engine, a rotational cam disposed on the camshaft, a swing shaft disposed parallel to the camshaft, and a swing cam supported with the swing shaft and being swingable with a movement of the rotational cam, an abutment portion displacing mechanism configured to displace the rotational cam abutment portion along the guide portion so as to change a relative distance between the rotational cam abutment portion and a center axis of the swing shaft, a rocker arm that is configured to be swung by the swing cam the rocker arm having a follower configured to contact the contoured cam face of the swing cam, wherein as the swing shaft is rotated to displace the drive shaft around the center axis of the swing shaft, the rotational cam abutment portion is displaced through the arm, so that the relative distance between the rotational cam abutment portion and the center axis of the swing shaft is changed and a relative position of the follower and the contoured face is changed, whereby a lift of the valve is changed, and wherein the guide portion is configured to allow the swing cam to swing through a range of orientations corresponding to a large lift zone, a small lift zone, and an idle running zone which overlaps with both of the large and small.

* * * * *